US010741190B2

(12) United States Patent
Srinivasan et al.

(10) Patent No.: US 10,741,190 B2
(45) **Date of Patent: *Aug. 11, 2020**

(54) METHODS AND APPARATUS FOR PERFORMING VARIABLE BLOCK LENGTH WATERMARKING OF MEDIA

(71) Applicant: THE NIELSEN COMPANY (US), LLC., New York, NY (US)

(72) Inventors: Venugopal Srinivasan, Tarpon Springs, FL (US); Alexander Topchy, Oldsmar, FL (US)

(73) Assignee: The Nielsen Company (US), LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/908,457

(22) Filed: Feb. 28, 2018

(65) Prior Publication Data

US 2018/0190301 A1 Jul. 5, 2018

Related U.S. Application Data

(63) Continuation of application No. 13/907,286, filed on May 31, 2013, now Pat. No. 9,947,327, which is a (Continued)

(51) Int. Cl.
*G10L 19/018* (2013.01)

(52) U.S. Cl.
CPC ..... *G10L 19/018* (2013.01)

(58) Field of Classification Search
CPC ..... G10L 19/018
See application file for complete search history.

(56) References Cited

U.S. PATENT DOCUMENTS 3,004,104 A 10/1961 Hembrooke
3,845,391 A 10/1974 Crosby
(Continued)

FOREIGN PATENT DOCUMENTS

AU 678163 11/1993
AU 718227 11/1997
(Continued)

OTHER PUBLICATIONS

Australian Government, "Examiner's First Report," issued in connection with Australian Patent Application No. 2008321318, dated Feb. 15, 2011, (2 pages).

(Continued)

*Primary Examiner* — Michael N Opsasnick
(74) *Attorney, Agent, or Firm* — Hanley, Flight & Zimmerman, LLC

(57) ABSTRACT

Disclosed example apparatus select a first frequency from a set of frequencies based on a first symbol in a code, and select a first block size based on the first symbol and the code, a combination of the first block size and the first frequency to represent the first symbol. Disclosed example apparatus also synthesize a code frequency according to the first block size and the first frequency. Disclosed example apparatus further embed the code frequency in a first block of input audio samples of the audio having the first block size to form a block of encoded audio samples encoded with the first symbol, the code frequency and the first block of input audio samples to overlap in time.

19 Claims, 9 Drawing Sheets

Related U.S. Application Data continuation of application No. 12/361,991, filed on Jan. 29, 2009, now Pat. No. 8,457,951.

(60) Provisional application No. 61/024,443, filed on Jan. 29, 2008.

(56) References Cited

U.S. PATENT DOCUMENTS 3,919,479 A 11/1975 Moon et al.
4,025,851 A 5/1977 Haselwood et al.
4,053,710 A 10/1977 Advani et al.
4,230,990 A 10/1980 Lert, Jr. et al.
4,282,403 A 8/1981 Sakoe
4,432,096 A 2/1984 Bunge
4,450,531 A 5/1984 Kenyon et al.
4,520,830 A 6/1985 Flanagan, III
4,533,926 A 8/1985 Foldvari et al.
4,547,804 A 10/1985 Greenberg
4,624,009 A 11/1986 Glenn et al.
4,639,779 A 1/1987 Greenberg
4,677,466 A 6/1987 Lert, Jr. et al.
4,697,209 A 9/1987 Kiewit et al.
4,703,476 A 10/1987 Howard
4,739,398 A 4/1988 Thomas et al.
4,783,660 A 11/1988 Pierce
4,805,020 A 2/1989 Greenberg
4,834,724 A 5/1989 Geiss et al.
4,843,562 A 6/1989 Kenyon et al.
4,931,871 A 6/1990 Kramer
4,945,412 A 7/1990 Kramer
4,947,436 A 8/1990 Greaves et al.
4,967,273 A 10/1990 Greenberg
5,023,929 A 6/1991 Call
5,113,437 A 5/1992 Best et al.
5,121,428 A 6/1992 Uchiyama et al.
5,210,820 A 5/1993 Kenyon
5,319,735 A 6/1994 Preuss et al.
5,436,653 A 7/1995 Ellis et al.
5,437,050 A 7/1995 Lamb et al.
5,450,490 A 9/1995 Jensen et al.
5,504,518 A 4/1996 Ellis et al.
5,563,942 A 10/1996 Tulai
5,572,246 A * 11/1996 Ellis ..... G06K 9/00711 725/22
5,574,962 A 11/1996 Fardeau et al.
5,579,124 A 11/1996 Aijala et al.
5,581,800 A 12/1996 Fardeau et al.
5,612,729 A 3/1997 Ellis et al.
5,621,454 A 4/1997 Ellis et al.
5,629,739 A 5/1997 Dougherty
5,650,943 A 7/1997 Powell et al.
5,687,191 A 11/1997 Lee et al.
5,764,763 A 6/1998 Jensen et al.
5,792,053 A 8/1998 Skladnev et al.
5,793,432 A 8/1998 Mishima et al.
5,822,360 A 10/1998 Lee et al.
5,941,822 A 8/1999 Skladnev et al.
5,983,172 A 11/1999 Takashima et al.
6,002,443 A 12/1999 Iggulden
6,026,323 A 2/2000 Skladnev et al.
6,061,793 A 5/2000 Tewfik et al.
6,115,689 A 9/2000 Malvar
6,151,578 A 11/2000 Bourcet et al.
6,170,060 B1 1/2001 Mott et al.
6,188,987 B1 * 2/2001 Fielder ..... H04N 21/23602 375/E7.271
6,205,249 B1 3/2001 Moskowitz
6,226,608 B1 * 5/2001 Fielder ..... G10L 19/022 345/545
6,246,345 B1 6/2001 Davidson et al.
6,272,176 B1 8/2001 Srinivasan
6,286,005 B1 9/2001 Cannon
6,317,703 B1 11/2001 Linsker
6,421,445 B1 7/2002 Jensen et al.
6,442,283 B1 8/2002 Tewfik et al.
6,469,749 B1 10/2002 Dimitrova et al.
6,571,144 B1 * 5/2003 Moses ..... G10L 19/018 380/236
6,580,809 B2 6/2003 Stach et al.
6,604,072 B2 8/2003 Pitman et al.
6,711,540 B1 3/2004 Barkowiak
6,725,372 B1 4/2004 Lewis et al.
6,751,337 B2 6/2004 Tewfik et al.
6,807,528 B1 10/2004 Truman et al.
6,845,360 B2 1/2005 Jensen et al.
6,862,355 B2 3/2005 Kolessar et al.
6,871,180 B1 3/2005 Neuhauser et al.
6,968,564 B1 11/2005 Srinivasan
6,983,058 B1 1/2006 Fukuoka et al.
6,996,237 B2 2/2006 Jensen et al.
7,003,131 B2 2/2006 Watson et al.
7,006,555 B1 * 2/2006 Srinivasan ..... H04H 20/31 375/133
7,013,468 B2 3/2006 Abercrombie et al.
7,031,491 B1 4/2006 Donescu et al.
7,035,700 B2 * 4/2006 Gopalan ..... G11B 20/00891 380/236
7,058,223 B2 6/2006 Cox
7,171,016 B1 1/2007 Rhoads
7,174,151 B2 2/2007 Lynch et al.
7,181,044 B2 2/2007 Watson et al.
7,194,752 B1 3/2007 Kenyon et al.
7,269,734 B1 9/2007 Johnson et al.
7,289,643 B2 10/2007 Brunk et al.
7,302,574 B2 11/2007 Conwell et al.
7,316,025 B1 1/2008 Aijala et al.
7,328,153 B2 2/2008 Wells et al.
7,330,812 B2 * 2/2008 Ding ..... G10L 19/018 370/352
7,343,492 B2 3/2008 Moskowitz et al.
7,346,514 B2 * 3/2008 Herre ..... G10L 19/018 704/200.1
7,441,712 B2 10/2008 Silverbrook et al.
7,454,327 B1 * 11/2008 Neubauer ..... G10L 19/018 375/146
7,454,331 B2 11/2008 Vinton et al.
7,509,115 B2 3/2009 Lynch et al.
7,555,432 B1 * 6/2009 Gopalan ..... G10L 19/018 380/252
7,640,141 B2 12/2009 Kolessar et al.
7,660,424 B2 2/2010 Davis
7,712,114 B2 5/2010 Ramaswamy
7,760,790 B2 * 7/2010 Baum ..... G10L 19/018 358/3.28
7,783,889 B2 8/2010 Srinivasan
7,933,417 B2 4/2011 Toyama et al.
7,961,881 B2 6/2011 Jensen et al.
RE42,627 E 8/2011 Neuhauser et al.
8,000,677 B2 8/2011 Lynch et al.
8,260,113 B2 9/2012 Aijala et al.
8,369,972 B2 2/2013 Topchy et al.
8,457,951 B2 * 6/2013 Srinivasan ..... G10L 19/018 704/207
9,460,730 B2 10/2016 Topchy et al.
9,947,327 B2 * 4/2018 Srinivasan ..... G10L 19/018
2001/0051996 A1 12/2001 Cooper et al.
2002/0082731 A1 6/2002 Pitman et al.
2002/0082837 A1 6/2002 Pitman et al.
2002/0126872 A1 9/2002 Brunk et al.
2002/0164046 A1 11/2002 Walker et al.
2002/0178410 A1 * 11/2002 Haitsma ..... G06K 9/00744 714/709
2003/0005430 A1 1/2003 Kolessar
2003/0054757 A1 3/2003 Kolessar et al.
2003/0055656 A1 3/2003 Tasaki
2003/0131350 A1 7/2003 Peiffer et al.
2003/0161536 A1 8/2003 Iwamura et al.
2003/0179909 A1 9/2003 Wong et al.
2004/0122679 A1 6/2004 Neuhauser et al.
2004/0148159 A1 7/2004 Crockett et al.
2004/0170381 A1 9/2004 Srinivasan
2004/0181799 A1 9/2004 Lu et al.

(56) References Cited

U.S. PATENT DOCUMENTS

| | | | |
|---|---|---|---|
| 2005/0015249 | A1 | 1/2005 | Mehrotra et al. |
| 2005/0025334 | A1 | 2/2005 | Tewfik et al. |
| 2005/0035857 | A1 | 2/2005 | Zhang et al. |
| 2005/0043830 | A1 | 2/2005 | Lee et al. |
| 2005/0052294 | A1 | 3/2005 | Liang et al. |
| 2005/0060147 | A1 | 3/2005 | Norimatsu et al. |
| 2005/0200476 | A1 | 9/2005 | Forr et al. |
| 2005/0203798 | A1 | 9/2005 | Jensen et al. |
| 2005/0216509 | A1 | 9/2005 | Kolessar et al. |
| 2005/0232411 | A1 | 10/2005 | Srinivasan et al. |
| 2005/0243784 | A1 | 11/2005 | Fitzgerald et al. |
| 2005/0268798 | A1 | 12/2005 | Neuhauser et al. |
| 2005/0272015 | A1 | 12/2005 | Jensen et al. |
| 2006/0020958 | A1 | 1/2006 | Allamanche et al. |
| 2006/0028953 | A1 | 2/2006 | Jensen et al. |
| 2006/0120536 | A1 | 6/2006 | Kemp |
| 2006/0075237 | A1 | 7/2006 | Seo et al. |
| 2006/0193490 | A1 | 8/2006 | Srinivasan et al. |
| 2006/0195886 | A1 | 8/2006 | Ashley |
| 2006/0239503 | A1 | 10/2006 | Petrovic et al. |
| 2007/0005118 | A1 | 1/2007 | Carter et al. |
| 2007/0014428 | A1 | 1/2007 | Kountchev et al. |
| 2007/0016415 | A1 | 1/2007 | Thumpudi et al. |
| 2007/0016418 | A1 | 1/2007 | Mehrotra et al. |
| 2007/0089552 | A1 | 4/2007 | Busch et al. |
| 2007/0124141 | A1 | 5/2007 | You |
| 2007/0199013 | A1 | 8/2007 | Samari et al. |
| 2007/0274537 | A1 | 11/2007 | Srinivasan |
| 2007/0286451 | A1 | 12/2007 | Rhoads |
| 2007/0300066 | A1 | 12/2007 | Srinivasan |
| 2008/0209219 | A1 | 8/2008 | Rhein |
| 2008/0276265 | A1 | 11/2008 | Topchy et al. |
| 2009/0037575 | A1 | 2/2009 | Crystal et al. |
| 2009/0055196 | A1 | 2/2009 | Oh et al. |
| 2009/0119110 | A1 | 5/2009 | Oh et al. |
| 2009/0192805 | A1 | 7/2009 | Topchy et al. |
| 2009/0234656 | A1 | 9/2009 | Oh et al. |
| 2009/0259325 | A1 | 10/2009 | Topchy et al. |
| 2010/0049474 | A1 | 2/2010 | Kolessar et al. |
| 2010/0226494 | A1 | 9/2010 | Lynch et al. |
| 2013/0114831 | A1 | 5/2013 | Topchy et al. |
| 2018/0254048 | A1 | 9/2018 | Topchy et al. |

FOREIGN PATENT DOCUMENTS

| | | |
|---|---|---|
| AU | 747044 | 9/2000 |
| AU | 2006203639 | 9/2006 |
| AU | 2008321318 | 2/2013 |
| CA | 2041754 | 12/2004 |
| CA | 2136054 | 6/2005 |
| CA | 2134748 | 7/2005 |
| CA | 2504552 | 1/2009 |
| CA | 2858944 | 5/2009 |
| CA | 2628654 | 12/2009 |
| CN | 1461565 | 12/2003 |
| DE | 69334130 | 12/2007 |
| DK | 1261155 | 8/2007 |
| EP | 0385799 | 9/1990 |
| EP | 0245037 | 9/1993 |
| EP | 0598682 | 5/1994 |
| EP | 0748563 | 1/2003 |
| EP | 0887958 | 1/2003 |
| EP | 1261155 | 9/2003 |
| EP | 1261155 | 3/2007 |
| ES | 2284777 | 11/2007 |
| FR | 2559002 | 8/1985 |
| GB | 2460773 | 10/2010 |
| JP | 8500471 | 1/1996 |
| JP | H10500263 | 1/1998 |
| JP | 11-110913 | 4/1999 |
| JP | 2003500702 | 1/2003 |
| JP | 2003530763 | 10/2003 |
| JP | 2011503659 | 1/2011 |
| PT | 1261155 | 7/2007 |
| WO | 88/10540 | 12/1988 |
| WO | 93/22875 | 11/1993 |
| WO | 94/11989 | 5/1994 |
| WO | 95/27349 | 10/1995 |
| WO | 98/41140 | 9/1998 |
| WO | 00/19699 | 4/2000 |
| WO | 00/35345 | 6/2000 |
| WO | 00/72309 | 11/2000 |
| WO | 00/79709 | 12/2000 |
| WO | 01/78271 | 10/2001 |
| WO | 02/065782 | 8/2002 |
| WO | 03/009277 | 1/2003 |
| WO | 03/057605 | 7/2003 |
| WO | 2006/023770 | 3/2006 |

OTHER PUBLICATIONS

Australian Government, "Examiner's Report No. 2", issued in connection with Australian Patent Application No. 2008321318, dated Feb. 21, 2012, (2 pages).

Australian Government, "Notice of Acceptance", issued in connection with Australian patent application No. 2008321318, dated Oct. 18, 2012, (1 page).

Australian Government, "Examiner's Report No. 1", issued in connection with Australian Patent Application No. 2012241085, dated Sep. 16, 2013, (3 pages).

Canadian Intellectual Property Office, "First Office action", issued in connection with Canadian Patent Application No. 2,705,549, dated Aug. 29, 2012, (2 pages).

Canadian Intellectual Property Office, "Office action", issued in connection with Canadian Patent Application No. 2,705,549, dated Oct. 22, 2013, (2 pages).

Canadian Intellectual Property Office, "Office action", issued in connection with Canadian Patent Application No. 2,705,549, dated Jul. 25, 2014, (2 pages).

Chinese Patent Office, "First Office action", issued in connection with Chinese Patent Application No. 200880120098.7, dated Aug. 29, 2011, (9 pages).

Chinese Patent Office, "Second Office action," issued in connection with Chinese Patent Application No. 200880120098.7, dated Jun. 20, 2012, (4 pages).

Chinese Patent Office, "Third Office action," issued in connection with Chinese Patent Application No. 200880120098.7, dated Feb. 28, 2013, (7 pages).

Chinese Patent Office, "Notice of Allowance," issued in connection with Chinese Patent Application No. 200880120098.7, dated Aug. 1, 2013, (4 pages).

Japanese Patent Office, "Summary of Office Action" and Text of Office action, issued in connection with Japanese Patent Application No. 2010-534075, dated Jul. 3, 2012, (4 pages).

Japanese Patent Office, "Notice of Allowance" and Text of Office action, issued in connection with Japanese Patent Application No. 2010-534075, dated Oct. 9, 2013, (5 pages).

European Patent Office, "Examination Report", issued in connection with European patent application No. 08850597.7-2225, dated Jun. 6, 2012, (9 pages).

International Searching Authority, "International Search Report" issued in connection with International application No. PCT/US2008/079595, dated Jan. 19, 2009, (4 pages).

International Searching Authority, "Written Opinion" issued in connection with International application No. PCT/US2008/079595, dated Jan. 19, 2009, (11 pages).

The International Bureau, "International Preliminary Report on Patentability," issued in connection with International application No. PCT/US2008/079595, dated May 18, 2010, (12 pages).

United States Patent and Trademark Office, "Notice of Allowance", issued in connection with U.S. Appl. No. 12/361,991, dated Feb. 21, 2012, (8 pages).

United States Patent and Trademark Office, "Supplemental Notice of Allowance", issued in connection with U.S. Appl. No. 12/361,991, dated May 24, 2012, (2 pages).

United States Patent and Trademark Office, "Notice of Allowance", issued in connection with U.S. Appl. No. 12/361,991, dated Aug. 21, 2012, (7 pages).

(56) References Cited

OTHER PUBLICATIONS

United States Patent and Trademark Office, "Notice of Allowance", issued in connection with U.S. Appl. No. 12/361,991, dated Feb. 7, 2013, (5 pages).
United States Patent and Trademark Office, "Supplemental Notice of Allowance", issued in connection with U.S. Appl. No. 12/361,991, dated Feb. 27, 2013, (2 pages).
United States Patent and Trademark Office, "Office Action", issued in connection with U.S. Appl. No. 12/249,619, dated Mar. 21, 2012, (21 pages).
United States Patent and Trademark Office, "Notice of Allowance", issued in connection with U.S. Appl. No. 12/249,619, dated Aug. 29, 2012, (10 pages).
United States Patent and Trademark Office, "Supplemental Notice of Allowance", issued in connection with U.S. Appl. No. 12/249,619, dated Sep. 21, 2012, (4 pages).
United States Patent and Trademark Office, "Notice of Allowance", issued in connection with U.S. Appl. No. 12/249,619, dated Dec. 26, 2012, (7 pages).
Doets et al., "Theoretical Modeling of a Robust Audio Fingerprinting System," Tech. Rep. Deift Univ. Technol., Deift, The Netherlands, 2004, (4 pages).
Sukittanon et al., "Modulation Scale Analysis for Content Identification", Dept of EE, University of Washington, Nov. 1, 2003, (12 pages).
Haitsma et al., Robust Audio Hashing for Content Identification, Philips Research, philips.com, 2001, (8 pages).
Crochiere et al. "Real-Time Speech Coding" Apr. 34, 1982, (14 pages).
Haitsma et al., "A Highly Robust Audio Fingerprinting System", 2002, (9 pages).
John Fredrick Arnold, Curriculum Vitae of John Fredrick Arnold, shown and sworn on Jun. 7, 2006, (39 pages).
Dr. Khok Khee Pang, Curriculum Vitae of Dr. Khok Khee Pang, shown and sworn on Mar. 27, 2006, (15 pages).
David John Bull, Curriculum Vitae of David John Bull, shown and sworn on Dec. 23, 2005 (6 pages).
Wai-Kai Chen, The Circuits and Filters Handbook , p. 137, 149, 157, 163, 721, and 2696. 1995, CRC Press.
United Kingdom Radio Academy, Techcon Conference, http://www.ibs.org.uk/public/lineuparchive/2003/Aug-Sep/TECHCON_2003.pdf, 2 pages, Jul. 2003.
IP Australia, "Notice of Acceptance," issued in connection with Application No. 2012241085, dated Oct. 8, 2014, 2 pages.
United States Patent and Trademark Office, "Non-Final Office Action," issued in connection with U.S. Appl. No. 13/730,271, dated Dec. 16, 2014, 49 pages.
European Patent Office, "Examination Report," issued in connection with Application No. 08850597.9, dated Feb. 25, 2015, 5 pages.
Canadian Intellectual Property Office, "Office Action," issued in connection with Application No. 2,858,944, dated Feb. 16, 2015, 5 pages.
Canadian Patent Office, "Office action", issued in connection with Canadian patent application No. 2,858,944, dated Jan. 19, 2016, 4 pages.
United States Patent and Trademark Office, "Non-Final Office Action," issued in connection with U.S. Appl. No. 13/730,271, dated Sep. 17, 2015, 10 pages.
United States Patent and Trademark Office, "Final Office Action," issued in connection with U.S. Appl. No. 13/730,271, dated Mar. 4, 2016, 10 pages.
United States Patent and Trademark Office, "Notice of Allowance," issued in connection with U.S. Appl. No. 13/730,271, dated May 27, 2016, 12 pages.
European Patent Office, "Intention to Grant," issued in connection with application No. 08850597.9, dated Dec. 5, 2016, 42 pages.
Canadian Intellectual Property Office, "Notice of Allowance," issued in connection with application No. 2858944, dated Feb. 1, 2017, 1 page.
United States Patent and Trademark Office, "Final Office Action," issued in connection with U.S. Appl. No. 13/907,286, dated Dec. 16, 2016, 7 pages.
European Patent Office, "Decision to Grant," issued in connection with European Patent Application No. 08850597.9, dated Apr. 28, 2017, 2 pages.
United States Patent and Trademark Office, "Non-Final Office Action," issued in connection with U.S. Appl. No. 13/907,286, dated Jun. 2, 2017, 6 pages.
United States Patent and Trademark Office, "Notice of Allowance and Fee(s) Due," issued in connection with U.S. Appl. No. 13/907,286, dated Dec. 6, 2017, 7 pages.
United States Patent and Trademark Office, "Non-Final Office Action," issued in connection with U.S. Appl. No. 13/730,271, dated May 13, 2015, 11 pages.
United States Patent and Trademark Office, "Final Office action," issued in connection with U.S. Appl. No. 15/973,154, dated Jul. 15, 2019, 5 pages.
United States Patent and Trademark Office, "Non-Final Office action," issued in connection with U.S. Appl. No. 15/973,154, dated Feb. 21, 2019, 12 pages.
International Bureau, "International Preliminary Report on Patentability," issued in connection with International Patent Application No. PCT/US2008/054434, dated Aug. 26, 2009, 10 pages.
International Bureau, "International Preliminary Report on Patentability," issued in connection with International Patent Application No. PCT/US2008/061783 dated Nov. 3, 2009, 8 pages.
International Bureau, "International Preliminary Report on Patentability," issued in connection with International Patent Application No. PCT/US2008/082657 dated Sep. 7, 2010, 7 pages.
International Searching Authority, "Written Opinion," issued in connection with International Patent Application No. PCT/US2008/061783, dated Jan. 29, 2009, 7 pages.
International Searching Authority, "International Search Report" issued in connection with International Patent Application No. PCT/US2008/061783, dated Jan. 22, 2009, 4 pages.
International Bureau, "Search Report," issued in connection with International Patent Application No. PCT/US2008/079595, dated Jan. 7, 2009, 4 pages.
International Searching Authority, "Written Opinion," issued in connection with International Patent Application No. PCT/US2008/082657, dated Apr. 7, 2009, 7 pages.
Japanese Patent Office, "Office Action," issued in connection with Japanese Patent Application No. 2010-534075, Jul. 2, 2013, 4 pages.
European Patent Office, "Summons to attend oral proceedings pursuant to Rule 115(1) EPC," issued in connection with European Patent Application No. 08850597.9, Apr. 14, 2016, 6 pages.
International Searching Authority, "International Search Report," issued in connection with International Patent Application No. PCT/US2008/054434, dated Feb. 25, 2009, 4 pages.
International Searching Authority, "Written Opinion," issued in connection with International Patent Application No. PCT/US2008/054434, dated Feb. 25, 2009, 9 pages.
United States Patent and Trademark Office, "Non-Final Office Action," issued in connection with U.S. Appl. No. 15/269,158, dated Aug. 21, 2017, 10 pages.
United States Patent and Trademark Office, "Notice of Allowance," issued in connection with U.S. Appl. No. 15/269,158, dated Jan. 10, 2018, 5 pages.
United States Patent and Trademark Office, "Notice of Allowance," issued in connection with U.S. Appl. No. 15/973,154, dated Oct. 21, 2019, 8 pages.

* cited by examiner

300

302 304

| Information Symbol | Block Size |
|---|---|
| $S_0$ | 2004 |
| $S_1$ | 2010 |
| $S_2$ | 2016 |
| $S_3$ | 2022 |
| $S_4$ | 2028 |
| $S_5$ | 2034 |
| $S_6$ | 2040 |
| $S_7$ | 2046 |

FIG. 3A

330

332 334 336

| Information Symbol | Block Size | Frequency Indices |
|---|---|---|
| $S_0$ | 2004 | 40, 56, 72, 88, 104, 120, 136 |
| $S_1$ | 2010 | 40, 56, 72, 88, 104, 120, 136 |
| $S_2$ | 2016 | 40, 56, 72, 88, 104, 120, 136 |
| $S_3$ | 2022 | 40, 56, 72, 88, 104, 120, 136 |
| $S_4$ | 2028 | 40, 56, 72, 88, 104, 120, 136 |
| $S_5$ | 2034 | 40, 56, 72, 88, 104, 120, 136 |
| $S_6$ | 2040 | 40, 56, 72, 88, 104, 120, 136 |
| $S_7$ | 2046 | 40, 56, 72, 88, 104, 120, 136 |

FIG. 3B

360

362 364 366

| Information Symbol | Block Sizes | Frequency Indices |
|---|---|---|
| $S_0$ | 2004 | 40, 56 |
| | 2022 | 88, 104 |
| | 2040 | 120, 136 |
| $S_1$ | 2010 | 40, 56 |
| | 2028 | 88, 104 |
| | 2046 | 120, 136 |
| $S_2$ | 2016 | 40, 56 |
| | 2034 | 88, 104 |
| | 2004 | 120, 136 |
| $S_3$ | 2022 | 40, 56 |
| | 2040 | 88, 104 |
| | 2010 | 120, 136 |
| $S_4$ | 2028 | 40, 56 |
| | 2046 | 88, 104 |
| | 2022 | 120, 136 |
| $S_5$ | 2034 | 40, 56 |
| | 2004 | 88, 104 |
| | 2022 | 120, 136 |
| $S_6$ | 2040 | 40, 56 |
| | 2010 | 88, 104 |
| | 2028 | 120, 136 |
| $S_7$ | 2046 | 40, 56 |
| | 2016 | 88, 104 |
| | 2034 | 120, 136 |

FIG. 3C

| Frequency Index ($k_m$) | Block Size ($N_m$) | | | | | | | |
|---|---|---|---|---|---|---|---|---|
| | 334 | 335 | 336 | 337 | 338 | 339 | 340 | 341 |
| 40 | $\cos\theta_{40,334}$, $\sin\theta_{40,334}$ | $\cos\theta_{40,335}$, $\sin\theta_{40,335}$ | … | … | … | … | … | $\cos\theta_{40,341}$, $\sin\theta_{40,341}$ |
| 56 | $\cos\theta_{56,334}$, $\sin\theta_{56,334}$ | … | … | … | … | … | … | … |
| 72 | … | … | … | … | … | … | … | … |
| 88 | … | … | … | … | … | … | … | … |
| 104 | … | … | … | … | … | … | … | … |
| 120 | … | … | … | … | … | … | … | … |
| 136 | $\cos\theta_{136,334}$, $\sin\theta_{136,334}$ | … | … | … | … | … | … | $\cos\theta_{136,341}$, $\sin\theta_{136,341}$ |

FIG. 6

| Frequency Index ($k_m$) | Block Size ($N_m$) | | | | | | | |
|---|---|---|---|---|---|---|---|---|
| | 334 | 335 | 336 | 337 | 338 | 339 | 340 | 341 |
| 40 | $\cos\varphi_{40,334}$, $\sin\varphi_{40,334}$ | $\cos\varphi_{40,335}$, $\sin\varphi_{40,335}$ | … | … | … | … | … | $\cos\varphi_{40,341}$, $\sin\varphi_{40,341}$ |
| 56 | $\cos\varphi_{56,334}$, $\sin\varphi_{56,334}$ | … | … | … | … | … | … | … |
| 72 | … | … | … | … | … | … | … | … |
| 88 | … | … | … | … | … | … | … | … |
| 104 | … | … | … | … | … | … | … | … |
| 120 | … | … | … | … | … | … | … | … |
| 136 | $\cos\varphi_{136,334}$, $\sin\varphi_{136,334}$ | … | … | … | … | … | … | $\cos\varphi_{136,341}$, $\sin\varphi_{136,341}$ |

FIG. 7

| Frequency Index ($k_m$) | Block Size ($N_m$) | | | | | | | |
|---|---|---|---|---|---|---|---|---|
| | 334 | 335 | 336 | 337 | 338 | 339 | 340 | 341 |
| 40 | $\mathbf{X}_{40,334}$ | $\mathbf{X}_{40,335}$ | … | … | … | … | … | $\mathbf{X}_{40,341}$ |
| 56 | $\mathbf{X}_{56,334}$ | … | … | … | … | … | … | … |
| 72 | … | … | … | … | … | … | … | … |
| 88 | … | … | … | … | … | … | … | … |
| 104 | … | … | … | … | … | … | … | … |
| 120 | … | … | … | … | … | … | … | … |
| 136 | $\mathbf{X}_{136,334}$ | … | … | … | … | … | … | $\mathbf{X}_{136,341}$ |

FIG. 8

METHODS AND APPARATUS FOR PERFORMING VARIABLE BLOCK LENGTH WATERMARKING OF MEDIA

RELATED APPLICATION APPLICATIONS

This patent is a continuation of U.S. patent application Ser. No. 13/907,286, entitled "METHOD AND APPARATUS FOR PERFORMING VARIABLE BLOCK LENGTH WATERMARKING OF MEDIA," filed on May 31, 2013, now U.S. Pat. No. 9,947,327, which is a continuation of U.S. patent application Ser. No. 12/361,991, entitled "METHOD AND APPARATUS FOR PERFORMING VARIABLE BLOCK LENGTH WATERMARKING OF MEDIA," filed on Jan. 29, 2009, now U.S. Pat. No. 8,457,951, which claims the benefit of U.S. Provisional Application No. 61/024,443, filed on Jan. 29, 2008. U.S. patent application Ser. No. 13/907,286, U.S. patent application Ser. No. 12/361,991, and U.S. Provisional Application No. 61/024,443 are incorporated herein by reference in their entirety.

TECHNICAL FIELD

The present disclosure relates generally to media monitoring and, more particularly, to methods and apparatus to perform variable block length watermarking of media.

BACKGROUND

Identifying media information and, more specifically, audio streams (e.g., audio information) is useful for assessing audience exposure to television, radio, or any other media. For example, in television audience metering applications, a code may be inserted into the audio or video of media, wherein the code is later detected at monitoring sites when the media is presented (e.g., played at monitored households). Monitoring sites typically include locations such as, for example, households where the media consumption of audience members or audience member exposure to the media is monitored. For example, at a monitoring site, codes from the audio and/or video are captured and may be associated with audio or video streams of media associated with a selected channel, radio station, media source, etc. The collected codes may then be sent to a central data collection facility for analysis. However, the collection of data pertinent to media exposure or consumption need not be limited to in-home exposure or consumption.

BRIEF DESCRIPTION OF THE DRAWINGS

FIG. 3A is a lookup table representing example block sizes representative of different information symbols for a given frequency index, wherein such a lookup table may be used by the block and index selector of FIG. 2.

FIG. 3B is a lookup table representing example block sizes and frequency indices representative of different information symbols, wherein each information symbol is represented by a single block size and several frequency indices and wherein such a lookup table may be used by the block and index selector of FIG. 2.

FIG. 3C is a lookup table representing example block sizes and frequency indices representative of different information symbols, wherein each information symbol is represented by several block sizes and several frequency indices for each block size and wherein such a lookup table may be used by the block and index selector of FIG. 2.

FIG. 6 is a lookup table showing complex twiddle factors for different frequency indices and block sizes for removing the spectral effects of an old sample from a buffer of previously stored audio information, wherein such a lookup table may be used in the decoder of FIG. 5.

FIG. 7 is a lookup table showing complex twiddle factors for different frequency indices and block sizes for adding the spectral effects of a new sample to the buffer of previously stored audio information, wherein such a lookup table may be used in the decoder of FIG. 5.

FIG. 8 is a lookup table showing the complex spectral amplitudes for different frequency indices and block sizes resulting from the removal of an old sample from a buffer and the addition of a new sample to the buffer of previously stored audio information, wherein such a lookup table may be used in the decoder of FIG. 5.

DETAILED DESCRIPTION

Figure 1:
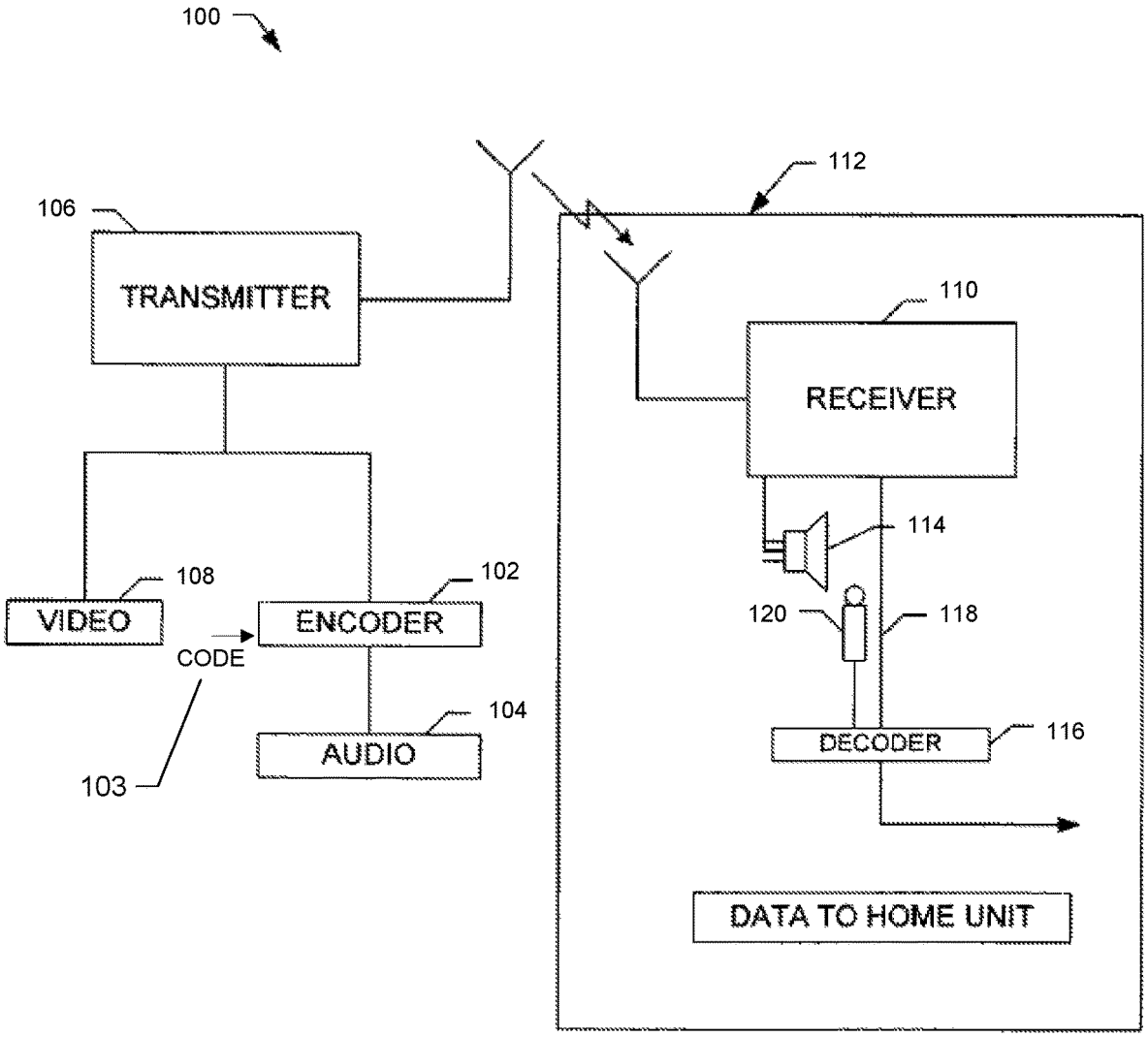
FIG. 1 is a schematic depiction of a broadcast audience measurement system employing a program identifying code added to the audio portion of a composite television signal.

The following description makes reference to audio encoding and decoding. It should be noted that in this context, audio may be any type of signal having a frequency falling within the normal human audibility spectrum. For example, audio may be speech, music, an audio portion of an audio and/or video program or work (e.g., a television program, a movie, an Internet video, a radio program, a commercial spot, etc.), a media program, noise, or any other sound.

In general, the encoding of the audio inserts one or more codes into the audio and ideally leaves the code inaudible to hearers of the audio. However, there may be certain situations in which the code may be audible to certain listeners. Additionally, the following refers to codes that may be encoded or embedded in audio; these codes may also be referred to as watermarks. The codes that are embedded in audio may be of any suitable length and any suitable technique for assigning the codes to information may be selected. Furthermore, as described below, the codes may be converted into symbols that are represented by signals having selected frequencies that are embedded in the audio. Any suitable encoding or error correcting technique may be used to convert codes into symbols.

The following examples pertain generally to encoding an audio signal with information, such as a code, and obtaining that information from the audio via a decoding process. The following example encoding and decoding processes may be used in several different technical applications to convey information from one place to another.

For example, the example encoding and decoding processes described herein may be used to perform broadcast identification. In such an example, before a work is broadcast, that work is encoded to include a code indicative of the source of the work, the broadcast time of the work, the distribution channel of the work, or any other information deemed relevant to the operator of the system. When the work is presented (e.g., played through a television, a radio, a computing device, or any other suitable device), persons in the area of the presentation are exposed not only to the work, but, unbeknownst to them, are also exposed to the code embedded in the work. Thus, persons may be provided with decoders that operate on a microphone-based platform so that the work may be obtained by the decoder using free-field detection and processed to extract codes therefrom. The codes may then be logged and reported back to a central facility for further processing. The microphone-based decoders may be dedicated, stand-alone devices, or may be implemented using cellular telephones or any other types of devices having microphones and software to perform the decoding and code logging operations. Alternatively, wire-based systems may be used whenever the work and its attendant code may be picked up via a hard wired connection to, for example, an audio output port, speaker terminal(s), and the like.

The example encoding and decoding processes described herein may be used, for example, in tracking and/or forensics related to audio and/or video works by, for example, marking copyrighted audio and/or associated video content with a particular code. The example encoding and decoding processes may be used to implement a transactional encoding system in which a unique code is inserted into a work when that work is purchased by a consumer. Thus, allowing a media distribution to identify a source of a work. The purchasing may include a purchaser physically receiving a tangible media (e.g., a compact disk, etc.) on which the work is included, or may include downloading of the work via a network, such as the Internet. In the context of transactional encoding systems, each purchaser of the same work receives the work, but the work received by each purchaser is encoded with a different code. That is, the code inserted in the work may be personal to the purchaser, wherein each work purchased by that purchaser includes that purchaser's code. Alternatively, each work may be may be encoded with a code that is serially assigned.

Furthermore, the example encoding and decoding techniques described herein may be used to carry out control functionality by hiding codes in a steganographic manner, wherein the hidden codes are used to control target devices programmed to respond to the codes. For example, control data may be hidden in a speech signal, or any other audio signal. A decoder in the area of the presented audio signal processes the received audio to obtain the hidden code. After obtaining the code, the target device takes some predetermined action based on the code. This may be useful, for example, in the case of changing advertisements within stores based on audio being presented in the store, etc. For example, scrolling billboard advertisements within a store may be synchronized to an audio commercial being presented in the store through the use of codes embedded in the audio commercial.

An example encoding and decoding system 100 is shown in FIG. 1. The example system 100 may be, for example, a television audience measurement system, which will serve as a context for further description of the encoding and decoding processes described herein. Thus, the information described hereinafter may be codes, data, etc. that is representative of audio and/or video program characteristics and/or other information useful in gathering or determining generate program exposure statistics. The example system 100 includes an encoder 102 that adds a code 103 to an audio signal 104 to produce an encoded audio signal.

As described below in detail, the encoder 102 samples the audio signal 104 at, for example, 48,000 Hz, and may insert a code into the audio signal 104 by modifying (or emphasizing) one or more energies or amplitudes specified by one or more frequency indices and a selected block size (or numerous different block sizes). Typically, the encoder 102 operates on the premise of encoding 18,432 samples (e.g., 9 blocks of 2048 samples) with a frequency or frequencies specified by one or more block sizes smaller than 2048 samples and one or more frequency indices within those blocks to send a symbol. Even though frequencies corresponding to various block sizes may be specified, in some example implementations the encoder 102 processes blocks of 18,432 samples and, therefore, a non-integral number of blocks may be used when encoding. For example, a block size of 2004 means that 9 blocks of 2004 audio samples are processed. This results in, for example 18,036 samples (i.e., 9 times 2004) that are encoded to contain the emphasized frequency. The 18,036 samples are then padded with 396 samples that also include the encoded information. Thus, an integral number of blocks is not used to encode the information.

The selection of different block sizes affects the frequencies that are visible by a decoder processing the received signal into a spectrum. For example, if energy at frequency index 40 for block size 2004 is boosted, that boosting will be visible at a decoder using a frequency spectrum produced by processing a block size of 2004 because the block size dictates the frequency bins at which the encoding information (e.g., the emphasized energy) is located. Conversely, the alteration of the frequency spectrum made at the encoder would be invisible to a decoder not processing received signals using a block size of 2004 because the energy input into the signal during encoding would not fall into bins having block sizes based on the block size of 2004.

The code 103 may be representative of any selected information. For example, in a media monitoring context, the code 103 may be representative of an identity of a broadcast media program such as a television broadcast, a radio broadcast, or the like. Additionally, the code 103 may include timing information indicative of a time at which the code 103 was inserted into audio or a media broadcast time. Alternatively, the code may include control information that is used to control the behavior of one or more target devices.

The audio signal 104 may be any form of audio including, for example, voice, music, noise, commercial advertisement audio, audio associated with a television program, a radio program, or any other audio related media. In the example of FIG. 1, the encoder 102 passes the encoded audio signal to a transmitter 106. The transmitter 106 transmits the encoded audio signal along with any video signal 108 associated with the encoded audio signal. While, in some instances, the encoded audio signal may have an associated video signal 108, the encoded audio signal need not have any associated video.

The transmitter 106 may include one or more of a radio frequency (RF) transmitter that may distribute the encoded audio signal through free space propagation (e.g., via terrestrial or satellite communication links) or a transmitter used to distribute the encoded audio signal through cable, fiber, a network, etc. In one example, the transmitter 106 may be used to broadcast the encoded audio signal throughout a broad geographical area. In other cases, the transmitter 106 may distribute the encoded audio signal through a limited geographical area. The transmission may include up-conversion of the encoded audio signal to radio frequencies to enable propagation of the same. Alternatively, the transmission may include distributing the encoded audio signal in the form of digital bits or packets of digital bits that may be transmitted over one or more networks, such as the Internet, wide area networks, or local area networks. Thus, the encoded audio signal may be carried by a carrier signal, by information packets or by any suitable technique to distribute the audio signals.

Although the transmit side of the example system 100 shown in FIG. 1 shows a single transmitter 106, the transmit side may be much more complex and may include multiple levels in a distribution chain through which the audio signal 104 may be passed. For example, the audio signal 104 may be generated at a national network level and passed to a local network level for local distribution. Accordingly, although the encoder 102 is shown in the transmit lineup prior to the transmitter 106, one or more encoders may be placed throughout the distribution chain of the audio signal 104. Thus, the audio signal 104 may be encoded at multiple levels and may include embedded codes associated with those multiple levels. Further details regarding encoding and example encoders are provided below.

When the encoded audio signal is received by a receiver 110, which, in the media monitoring context, may be located at a statistically selected metering site 112, the audio signal portion of the received program signal is processed to recover the code (e.g., the code 103), even though the presence of that code is imperceptible (or substantially imperceptible) to a listener when the encoded audio signal is presented by speakers 114 of the receiver 110. To this end, a decoder 116 is connected either directly to an audio output 118 available at the receiver 110 or to a microphone 120 placed in the vicinity of the speakers 114 through which the audio is reproduced. The received audio signal can be either in a monaural or stereo format.

As described below, the decoder 116 processes the received audio signal to obtain the energy at frequencies corresponding to every combination of relevant block size and relevant frequency index to determine which block sizes and frequency indices may have been modified or emphasized at the encoder 102 to insert data in the audio signal. Because the decoder 116 can never be certain when a code will be received, the decoder 116 process received samples one at a time using a sliding buffer of received audio information. The sliding buffer adds one new audio sample to the buffer and removes the oldest audio sample therefrom. The spectral effect of the new and old samples on the spectral content of the buffer is evaluated by multiplying the incoming and outgoing samples by twiddle factors. Thus, the decoding may be carried out using a number of twiddle factors to remove and add audio information to a buffer of audio information and to, thereby, determine the effect of the new information on a spectrum of buffered audio information. This approach eliminates the need to process received samples in blocks of different sizes.

Additionally, the sampling frequencies of the encoder 102 and the decoder 116 need not be the same but, advantageously, may be integral multiples of one another. For example, the sampling frequency used at the decoder 116 may be for example, 8 KHz, which is one-sixth of the sampling frequency of 48 KHz used at the encoder 102. Thus, the frequency indices and the block sizes used at the decoder 116 must be adjusted to compensate for the reduction in the sampling rate at the decoder 116. Further details regarding decoding and example decoders are provided below.

Audio Encoding

Figure 2:
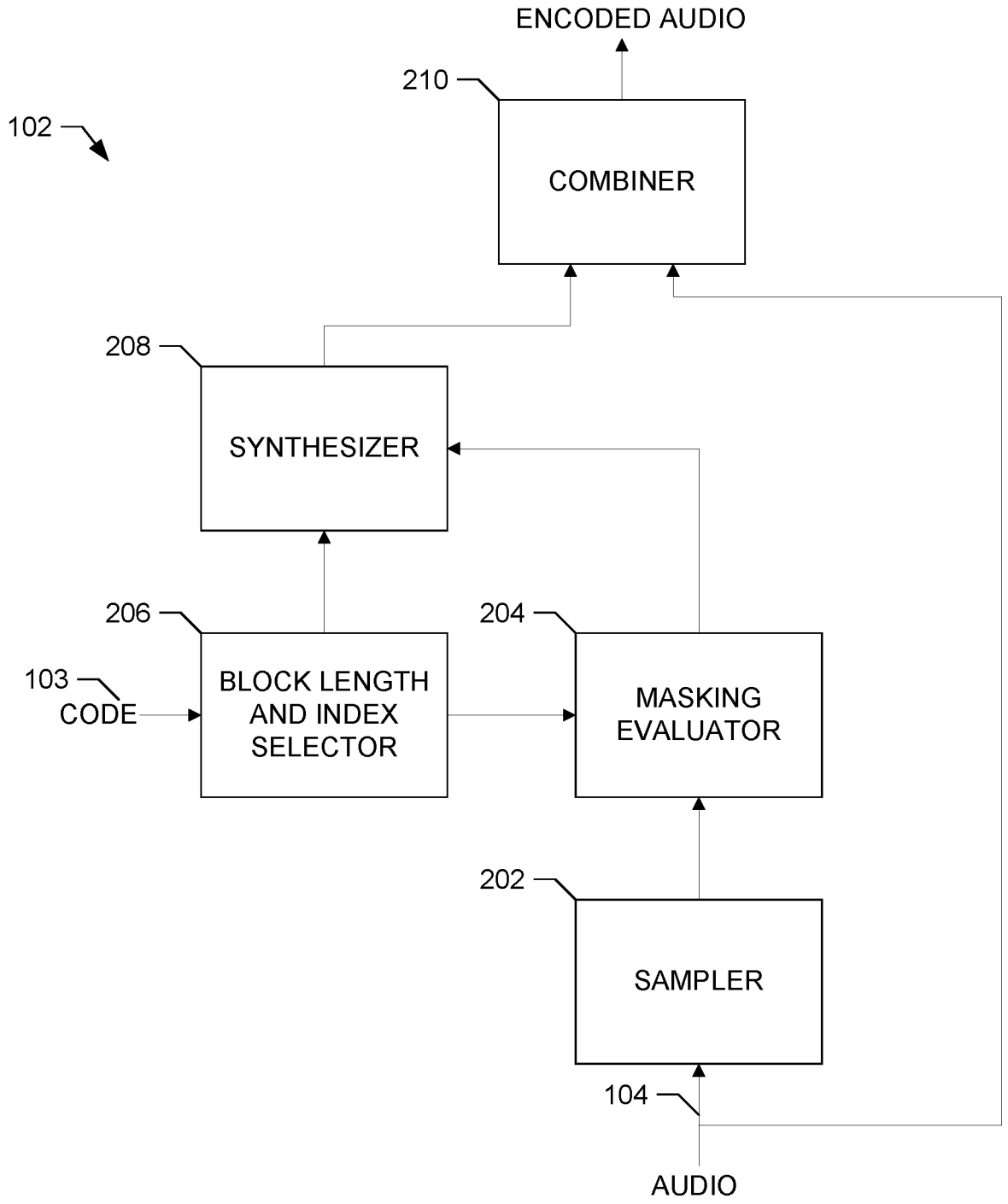
FIG. 2 is a block diagram of an example encoder that may be used to implement the encoder of FIG. 1.

As explained above, the encoder 102 inserts one or more inaudible (or substantially inaudible) codes into the audio 104 to create encoded audio. One example encoder 102 is shown in FIG. 2. In one implementation, the example encoder 102 of FIG. 2 includes a sampler 202 that receives the audio 104. The sampler 202 is coupled to a masking evaluator 204, which evaluates the ability of the sampled audio to hide codes therein. The code 103 is provided to a block length and index selector 206 that determines the audio block length and frequency index, which dictates the audio code frequencies used to represent the code 103 to be inserted into the audio. The block length and index selector 206 may include conversion of codes into set of symbols and/or any suitable detection or correction encoding. An indication of the designated block length and indices (or the code frequencies corresponding thereto) that will be used to represent the code 103 are passed to the masking evaluator 204 so that the masking evaluator 204 is aware of the frequencies for which masking by the audio 104 should be determined. Additionally, the indication of the block length and the indices (or the code frequencies corresponding thereto) are provided to a synthesizer 208 that produces synthesized code frequency sine wave signals having frequencies designated by the block length and index selector 206. A combiner 210 receives both the synthesized code frequencies from the synthesizer 208 and the audio that was provided to the sampler and combines the two to produce encoded audio.

In one example in which the audio 104 is provided to the encoder 102 in analog form, the sampler 202 may be implemented using an analog-to-digital (A/D) converter or any other suitable sampler. The sampler 202 may sample the audio 104 at, for example, 48,000 Hertz (Hz) or any other sampling rate suitable to sample the audio 104 while satisfying the Nyquist criteria. For example, if the audio 104 is frequency-limited at 15,000 Hz, the sampler 202 may operate at 30,000 Hz. Each sample from the sampler 202 may be represented by a string of digital bits, wherein the number of bits in the string indicates the precision with which the sampling is carried out. For example, the sampler 202 may produce 8-bit, 16-bit, 32-bit, or 64-bit samples. Alternatively, the sampling need not be carried out using a fixed number of bits of resolution. That is, the number of bits used to represent a particular sample may be adjusted based on the magnitude of the audio 104 being sampled.

In addition to sampling the audio 104, the example sampler 202 accumulates a number of samples (i.e., an audio block) that are to be processed together. As described below, audio blocks may have different sizes but, in one example, are less than or equal to 2048 samples in length. For example, the example sampler 202 accumulates 2048 samples of audio that are passed to the masking evaluator 204 at one time. Alternatively, in one example, the masking evaluator 204 may include buffer in which a number of samples (e.g., 512) may be accumulated before they are processed.

The masking evaluator 204 receives or accumulates the samples (e.g., 2048 samples) and determines an ability of the accumulated samples to hide code frequencies (e.g., the code frequencies corresponding to the block length and index specified by the block length and index selector 206) to human hearing. That is, the masking evaluator 204 determines if code frequencies specified by the block length and index selector 206 can be hidden within the audio represented by the accumulated samples by evaluating each critical band of the audio as a whole to determine its energy and determining the noise-like or tonal-like attributes of each critical band and determining the sum total ability of the critical bands to mask the code frequencies. Critical frequency bands, which were determined by experimental studies carried out on human auditory perception, may vary in width from single frequency bands at the low end of the spectrum to bands containing ten or more adjacent frequency bins at the upper end of the audible spectrum. If the masking evaluator 204 determines that code frequencies can be hidden in the audio 104, the masking evaluator 204 indicates the amplitude levels at which the code frequencies can be synthesized and inserted within the audio 104, while still remaining hidden and provides the amplitude information to the synthesizer 208. In one example, the masking evaluator 204 may operate on 2048 samples of audio, regardless of the block size selected to send the code. Masking evaluation is done on blocks of 512-sample sub-blocks with a 256 sample overlap, which means that of a 512-sample sub-block 256 samples are old and 256 samples are new. In a 2048 sample block, 8 such evaluations are performed consecutively. However, other block sizes may be used for masking evaluation purposes.

In one example, the masking evaluator 204 conducts the masking evaluation by determining a maximum change in energy $E_b$ or a masking energy level that can occur at any critical frequency band without making the change perceptible to a listener. The masking evaluation carried out by the masking evaluator 204 may be carried out as outlined in the Moving Pictures Experts Group—Advanced Audio Encoding (MPEG-AAC) audio compression standard ISO/IEC 13818-7:1997, for example. The acoustic energy in each critical band influences the masking energy of its neighbors and algorithms for computing the masking effect are described in the standards document such as ISO/IEC 13818-7:1997. These analyses may be used to determine for each audio block the masking contribution due to tonality (e.g., how much the audio being evaluated is like a tone) as well as noise like (i.e., how much the audio being evaluated is like noise) features in each critical band. The resulting analysis by the masking evaluator 204 provides a determination, on a per critical band basis, the amplitude of a code frequency that can be added to the audio 104 without producing any noticeable audio degradation (e.g., without being audible).

In one example, the block length and index selector 206 may be implemented using a lookup table pr any suitable data processing technique that relates an input code 103 to a state, wherein each state is represented by a number of code frequencies that are to be emphasized in the encoded audio signal according to a selected block length and index. In one example, those code frequencies are defined in a lookup table by a combination of frequency index and block size.

The relationship between frequency, frequency index, and block size is described below. If a block of N samples is converted from the time domain into the frequency domain by, for example, a Discrete Fourier Transform (DFT), the results may be represented spectral representation of Equation 1.

$$X(k) = \sum_{n=0}^{n=N-1} x(n)\exp\left(-j\frac{2\pi kn}{N}\right) \quad \text{Equation 1}$$

where x(n), n=0, 1, . . . N−1 are the time domain values of audio samples taken at sampling frequency $F_s$, X(k) is the complex spectral Fourier coefficient with frequency index k and 0≤k<N. Frequency index k can be converted into a frequency according to Equation 2.

$$f_k = \frac{kF_s}{N} \text{ for } 0 \le k < \frac{N}{2} - 1 \quad \text{Equation 2}$$

Where $f_k$ is a frequency corresponding to the index k.

The frequency increments Δf between consecutive indexes (values of k) are $$\Delta f = \frac{F_s}{N}.$$

The set of frequencies $\{f_k\}$, $$0 \le k < \frac{N}{2} - 1$$

is referred to as the set of observable frequencies in a block of size N. Thus, the observable frequencies are functions of block size (N), wherein different block sizes yield different observable frequencies.

With respect to a watermark representing a code to be inserted at a specified frequency index ($k_m$) of a specified block size (N), the frequency ($f_m$) of that watermark code frequency may be represented as shown in Equation 3.

$$f_m = \frac{k_m F_s}{N} \quad \text{Equation 3}$$

Having described how code frequencies relate to frequency indices and block sizes above, reference is now made to FIGS. 3A-3C, which show how codes or symbols may be represented using frequency indices and/or block sizes. As described in conjunction with FIGS. 3A-3C, the example watermark encoding techniques described herein use a variable block size to signal different communication symbols.

Referring to FIG. 3A, a lookup table 300 includes columns designating information symbols 302 and block sizes 304 corresponding to those symbols. Use of the lookup table 300 presumes a constant frequency index (for example, $k_m$=40) in varying block lengths that are smaller than the block length 2048, which is used by the encoder 102 during the encoding processing. For example, as shown in the lookup table 300, the symbols S0, 51, S2, S3, S4, S5, S6, S7 correspond to the block sizes 2004, 2010, 2016, 2022, 2028, 2034, 2040 and 2046, respectfully. Because there are 8 unique symbols, each of these symbols can represent a 3-bit data packet. Thus, when using the lookup table 300, the block length and index selector 206 receives the code 103, determines which symbol or symbols 302 to which the code 103 corresponds, and outputs an indication of the block size 304 that should be used to represent the symbol. The indication of the block size may be provided to the masking evaluator 204, if the masking evaluation depends on the block size, and to the synthesizer 208 so that the synthesizer can generate an appropriate code frequency defined by the block size and/or selected index.

Alternatively, the block length and index selector 206, may receive the code 103 and use a lookup table, such as the lookup table 330 of FIG. 3B. The lookup table 330 includes columns corresponding to each of information symbols 332, block size 334, and frequency indices 336. In operation, the block length and index selector 206, which is using a lookup table similar to that of FIG. 3B, receives the code 103 and determines the symbol or symbols to which the code corresponds. Subsequently, the block length and index selector 206 outputs both a block size 334 and frequency indices 336 to which desired symbols 332 correspond. As shown in FIG. 3B, there may be several frequency indices 336 that correspond to each block size 334, and the frequency indices corresponding to each block size 334 may be identical. As described above, the block size and frequency indices are communicated to the synthesizer 208 and/or the masking evaluator 204 (if necessary).

While the information symbols in FIGS. 3A and 3B correspond only to one block and, within that block, one or more frequency indices, a lookup table 360 shown in FIG. 3C may be used to specify, for each information symbol 362, multiple block sizes 364, each of which corresponds to multiple frequency indices 366. As shown in FIG. 3C, the frequency indices may be selected such that block sizes that are relatively close to one another have frequency indices that are relatively far from one another. Likewise, the block sizes selected to represent a particular information symbol may be non-adjacent values of block sizes. In some examples, the spacing of the block sizes and the frequency indices are selected to provide as much frequency spread as possible between adjacent symbols and within representations of a particular symbol.

Returning now to FIG. 2, as described above, the synthesizer 208 receives from the block length and index selector 206 an indication of the block lengths and frequency indices required to be emphasized to create an encoded audio signal including an indication of the input code. In response to the indication of the frequency indices, the synthesizer 208 generates one or a number of sine waves (or one composite signal including multiple sine waves) having the identified frequencies (i.e., the frequencies defined by the block size and the frequency indices). The synthesis may result in sine wave signals or in digital data representative of sine wave signals. In one example, the synthesizer 208 generates the code frequencies with amplitudes dictated by the masking evaluator 204. In another example, the synthesizer 208 generates the code frequencies having fixed amplitudes and those amplitudes may be adjusted by one or more gain blocks (not shown) that is within the code synthesizer 208 or is disposed between the synthesizer 208 and the combiner 210.

For example, to embed symbol S2 according to lookup table 300, the synthesizer would synthesize a signal according to Equation 4.

$$w(n) = A_w \cos\left(\frac{2\pi \cdot 40n}{2016}\right) \qquad \text{Equation 4}$$

where n=0 . . . 2015 is the time domain sample index within the block and $A_w$ is the amplitude computed provided from a psycho-acoustic masking model of the masking evaluator. If the masking evaluation is performed using consecutive 512-sample overlapping sub-blocks, with a 256-sample overlap, $A_w$ is varied from sub-block to sub-block and the code signal is multiplied by an appropriate window function to prevent edge effects. In such an arrangement, this synthesized sinusoid will only be fully observable when performing a spectral analysis using a block size of 2016 or, considering an 8 KHz sampling rate at the decoder 116, a block size of 336. However, the watermark signal can be chosen to be of arbitrary duration. In one example implementation, this watermark signal may be repeated in 9 consecutive blocks each the block size dictated by the block length and index selector 206. Note that the processing block size is chosen to support the use of commonly used psychoacoustic models such as MPEG-AAC. For the example given here the signal will be embedded in 9 blocks of 2016 samples followed by an additional 288 samples to include all the 9 blocks of 2048 samples.

While the foregoing describes an example synthesizer 208 that generates one or more sine waves or data representing sine waves corresponding to one or more block sizes and one or more frequency indices, other example implementations of synthesizers are possible. For example, rather than generating sine waves, another example synthesizer 208 may output frequency domain coefficients that are used to adjust amplitudes of certain frequencies of audio provided to the combiner 210. In this manner, the spectrum of the audio may be adjusted to include the requisite sine waves.

The combiner 210 receives both the output of the synthesizer 208 and the audio 104 and combines them to form encoded audio. The combiner 210 may combine the output of the synthesizer 208 and the audio 104 in an analog or digital form. If the combiner 210 performs a digital combination, the output of the synthesizer 208 may be combined with the output of the sampler 202, rather than the audio 104 that is input to the sampler 202. For example, the audio block in digital form may be combined with the sine waves in digital form. Alternatively, the combination may be carried out in the frequency domain, wherein frequency coefficients of the audio are adjusted in accordance with frequency coefficients representing the sine waves. As a further alternative, the sine waves and the audio may be combined in analog form. The encoded audio may be output from the combiner 210 in analog or digital form. If the output of the combiner 210 is digital, it may be subsequently converted to analog form before being coupled to the transmitter 106.

Figure 4:
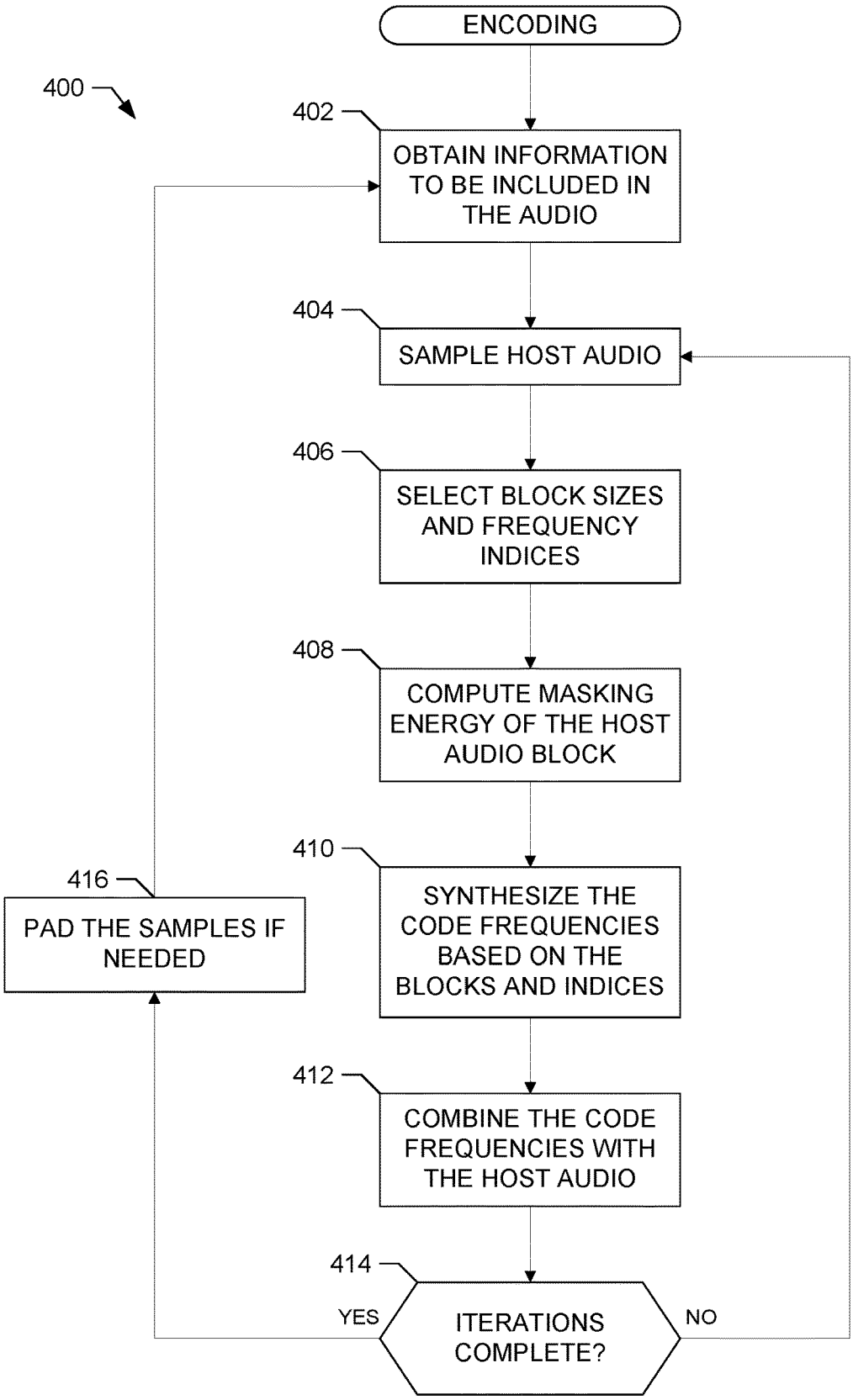
FIG. 4 is a flow diagram illustrating an example encoding process that may be carried out by the example encoder of FIG. 2.

An example encoding process 400 is shown in FIG. 4. The example process 400 may be carried out by the example encoder 102 shown in FIG. 2, or by any other suitable encoder. The example process 400 begins when the code, for example, the code 103 of FIGS. 1 and 2, to be included in the audio is obtained (block 402). The code may be obtained via a data file, a memory, a register, an input port, a network connection, or any other suitable technique.

After the code is obtained (block 402), the example process 400 samples the audio into which the code is to be embedded (block 404). The sampling may be carried out at 48,000 Hz or at any other suitable sampling frequency. The example process 400 then selects one or more block sizes and one or more frequency indices that will be used to represent the information to be included in the audio, which was obtained earlier at block 402 (block 406). As described above in conjunction with the block length and index selector 206, one or more lookup tables 300, 330, 360 may be used to select block lengths and/or corresponding frequency indices.

For example, to represent a particular symbol, a block size of 2016 and a frequency index of 40 may be selected. In some examples, blocks of samples may include both old samples (e.g., samples that have been used before in encoding information into audio) and new samples (e.g., samples that have not been used before in encoding information into audio). For example, a block of 2016 audio samples may include 2015 old samples and 1 new sample, wherein the oldest sample is shifted out to make room for the newest sample.

The example process 400 then determines the masking energy provided by the audio block (e.g., the block of 2016 samples) and, therefore, the corresponding ability to hide additional information inserted into the audio at the selected block size and frequency index (block 408). As explained above, the masking evaluation may include conversion of the audio block to the frequency domain and consideration of the tonal or noise-like properties of the audio block, as well as the amplitudes at various frequencies in the block. Alternatively, the evaluation may be carried out in the time domain. Additionally, the masking may also include consideration of audio that was in a previous audio block. As noted above, the masking evaluation may be carried out in accordance with the MPEG-AAC audio compression standard ISO/IEC 13818-7:1997, for example. The result of the masking evaluation is a determination of the amplitudes or energies of the code frequencies inserted at the specified block size and frequency index that are to be added to the audio block, while such code frequencies remain inaudible or substantially inaudible to human hearing.

Having determined the amplitudes or energies at which the code frequencies should be generated (block 408), the example process 400 synthesizes one or more sine waves having the code frequencies specified by the block size and the frequency index (block 410). The synthesis may result in actual sine waves or may result in digital data representative of sine waves. In one example, the sine waves may be synthesized with amplitudes specified by the masking evaluation. Alternatively, the code frequencies may be synthesized with fixed amplitudes and then amplitudes of the code frequencies may be adjusted subsequent to synthesis.

The example process 400 then combines the synthesized code frequencies with the audio block (block 412). For example, the code frequencies specified by the block size (or sizes) and frequency index (or indices) are combined with blocks having the specified block size. That is, if block size of 2016 samples is selected (block 406 of FIG. 4), the code frequencies corresponding to that block size are inserted into blocks having those sizes. The combination of the code frequencies and the audio blocks may be carried out through addition of data representing the audio block and data representing the synthesized sine waves, or may be carried out in any other suitable manner. In another example, the code frequency synthesis (block 410) and the combination (block 412) may be carried out in the frequency domain, wherein frequency coefficients representative of the audio block in the frequency domain are adjusted per the frequency domain coefficients of the synthesized sine waves.

As explained above, the code frequencies are redundantly encoded into consecutive audio blocks. In one example, a particular set of code frequencies is encoded into 9 consecutive blocks of 2016 samples. Thus, the example process 400 monitors whether it has completed the requisite number of iterations (block 414) (e.g., the process 400 determines whether the example process 400 has been repeated 9 times in 2016 sample blocks to redundantly encode the code frequencies). If the example process 400 has not completed the requisite iterations (block 414), the example process 400 samples audio (block 404), selects block size(s) and frequency indices (block 406), analyses the masking properties of the same (block 408), synthesizes the code frequencies (block 410) and combines the code frequencies with the newly acquired audio block (block 412), thereby encoding another audio block with the code frequencies.

However, when the requisite iterations to redundantly encode the code frequencies into audio blocks have completed (block 414), pads the samples if such padding is required (block 416). As explained above, the processing block size is chosen to support the use of commonly used psycho-acoustic models such as MPEG-AAC. For example, the code signal will be added into 9 blocks of 2016 samples that will be followed by an additional 288 samples of padding to include all 18,432 samples. Padding will effectively leave these 288 samples of the host audio unchanged.

After any necessary padding is carried out, the example process 400 obtains the next code to be included in the audio (block 402) and the example process 400 iterates. Thus, the example process 400 encodes a first code into a predetermined number of audio blocks, before selecting the next code to encode into a predetermined number of audio blocks, and so on. It is, however, possible, that there is not always a code to be embedded in the audio. In that instance, the example process 400 may be bypassed. Alternatively, if no code to be included is obtained (block 402), no code frequencies will by synthesized (block 410) and, thus, there will be no code frequencies to alter an audio block. Thus, the example process 400 may still operate, but audio blocks may not always be modified—especially when there is no code to be included in the audio.

Additionally, in addition to sending and receiving information, a certain known unique combination of the symbols S0, S1, S3, S4, S5, S6, S7 in each of the frequency indexes may used to indicate a synchronization sequence of blocks. The detection of a peak spectral power corresponding to this combination indicates to the decoder 116 that the subsequent sequence of samples should be interpreted as containing data. In one example, the watermark data are encoded in 3-bit packets and a message can consist of several such 3-bit data packets. Of course, other encoding techniques may be used.

Audio Decoding

In general, the decoder 116 detects the code frequencies that were inserted into or emphasized in the audio (e.g., the audio 104) to form encoded audio at the encoder 102. That is, the decoder 116 looks for a pattern of emphasis in code frequencies it processes. As described above in conjunction with the encoding processes, the code frequency emphasis may be carried out at one or more frequencies that are defined by block sizes and frequency indices. Thus, the visibility of the encoded information varies based on the block sizes that are used when the decoder 116 processes the received audio. Once the decoder 116 has determined which of the code frequencies have been emphasized, the decoder 116 determines, based on the emphasized code frequencies, the symbol present within the encoded audio. The decoder 116 may record the symbols, or may decode those symbols into the codes that were provided to the encoder 102 for insertion into the audio.

As described above in conjunction with audio encoding, the information inserted in or combined with the audio may be present at frequencies that may be invisible when performing decoding processing on the encoded signals with an incorrect block size. For example, if the encoded signals are processed with a 2046 sample block size at the decoder when the encoding was done at a frequency corresponding to a 2016 sample block size, the encoding will be invisible to the 2046 sample block size processing. Thus, while a decoder is generally aware of the code frequencies that may be used to encode information at the encoder, the decoder has no specific knowledge of the particular block sizes that should be used during decoding.

Accordingly, the decoder 116 uses a sliding buffer and twiddle factor tables to add information to the buffer and to subtract (or remove) information from the buffer as new information is added (or combined). This form of computation enables the decoder to update spectral values (e.g., the frequencies at which information may be encoded) on a sample-by-sample basis and, therefore, allows simultaneous computation of the spectrum corresponding to various block sizes and frequency indices using a set of twiddle factor tables. For example, a linear buffer containing 9*2048=18,432 samples has current values for the real and imaginary parts of the spectral amplitude for index $k_m$ with a block size $N_m$ that are referred to as $X_R$ and $X_I$, respectively. To analyze the effect of inserting a new sample of audio with amplitude $A_x$ from the sampled audio stream, the samples in the linear buffer are shifted to the left such that oldest sample $A_0$ is removed from the buffer and the most recent sample $A_x$ is added as the newest member in the buffer. The effect on $X_R$ and $X_I$ arising from this operation is what is to be computed. From the effect on $X_R$ and $X_I$, the changes to the amplitudes or energies at the frequencies of interest in the receive signal can be determined. Based on the changes to the frequencies of interest, the information that was included in the audio at the encoder 102 may be determined.

Figure 5:
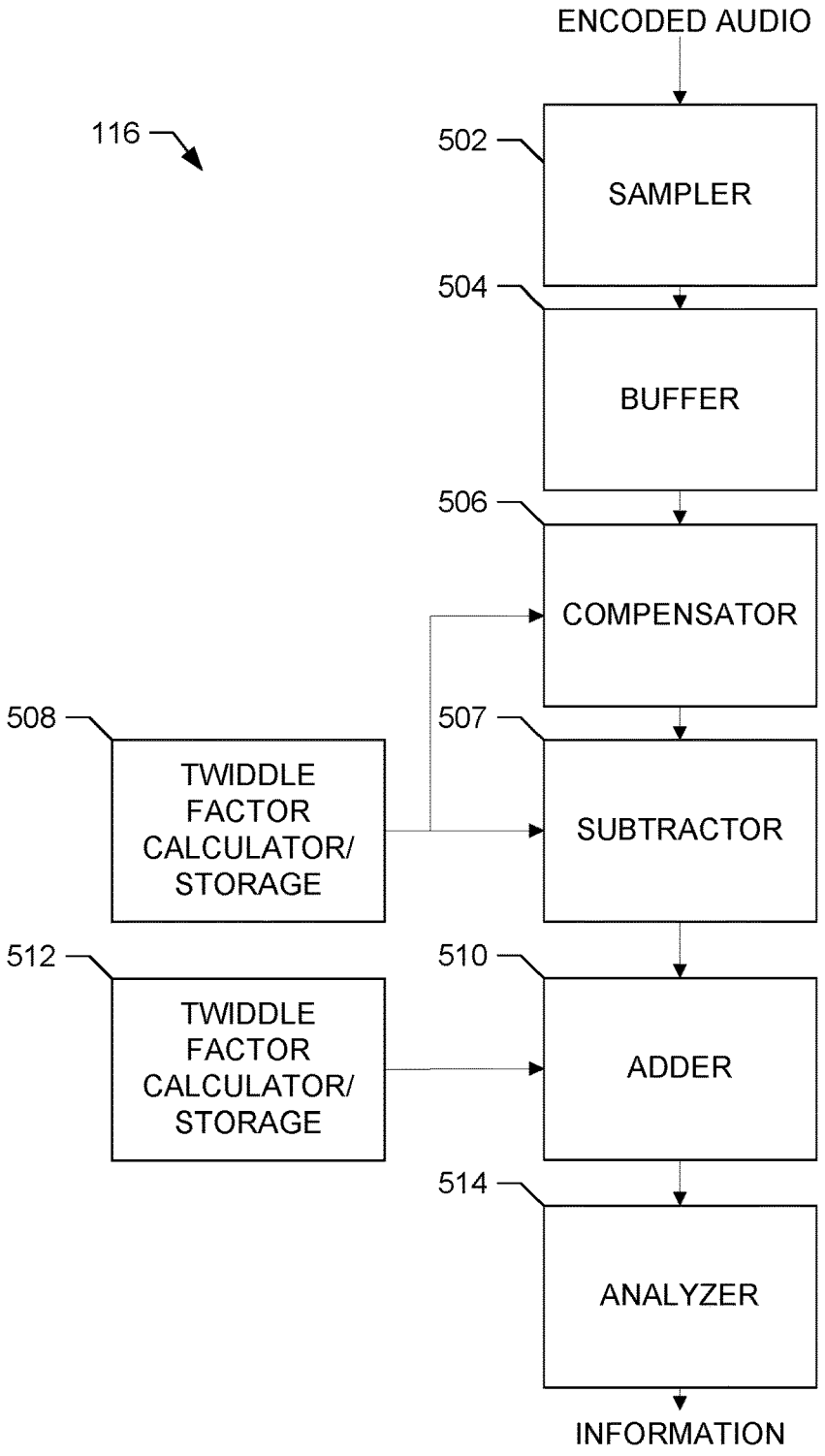
FIG. 5 is a block diagram of an example decoder of FIG. 1.

As shown in FIG. 5, the decoder 116 receives encoded audio at a sampler 502, which may be implemented using an A/D or any other suitable technology, to which encoded audio is provided in analog format. As shown in FIG. 1, the encoded audio may be provided by a wired or wireless connection to the receiver 110. The sampler 502 samples the encoded audio at, for example, a sampling frequency of, for example 8 kHz. At a sampling frequency of 8 kHz the Nyquist frequency is 4 kHz and therefore all the embedded code frequencies are preserved because they are lower than the Nyquist frequency. The 18,432-sample DFT block length at 48 kHz sampling rate is reduced to 3072 samples at 8 kHz sampling rate. Thus, at an 8 kHz sampling rate, the block sizes are one-sixth of those generated at the 48 kHz rate and, therefore, the block sizes used in the encoder are reduced by a factor of six when evaluated in the decoder. Of course, other sampling frequencies such as, for example, 48 KHz may be selected.

In one example, the samples from the sampler 502 are individually provided to a buffer 504 holding 18,432 samples (i.e., 9, 2048 sample blocks). Alternatively, multiple samples may be moved into the buffer 504 at one time. Advantageously, the spectral characteristics of the buffer 504 may be stored in a spectral characteristics table (such as the lookup table of FIG. 8, described below) that may be operated on as described below to account for samples leaving the buffer and samples being added to the buffer. The determination of the effects of the removal and addition of samples to the buffer alleviates the need for a frequency transformation to be performed each time a sample is received and further eliminates the need to perform frequency transformations using different block sizes and frequency indices. Of course, when the buffer 504 is empty at the start of decoder 116 operation, the frequency spectrum thereof is not representative of received sample. However, as the buffer 504 fills with samples, the frequency spectrum begins to represent the frequency spectrum of the received samples.

A compensator 506 then compensates for the fact that time has elapsed since the frequency spectrum, e.g., the frequency spectrum stored in FIG. 8, has been calculated. That is, the compensator 506 compensates for time that has passed and the effect that the time passage has on the frequency spectrum stored in FIG. 8. This compensation is described below in conjunction with Equations 5 and 6. In particular, Equations 5 and 6 are used to advance the frequency response of the buffer forward in time without having to recalculate an entire DFT. That is, before the effects of an old sample are removed and the effects of a new sample are added, the frequency representation of the buffer must be moved forward in a time that accounts for the presence of a new sample to be added to the buffer. Of course, Equations 5 and 6 include operations on the frequency response of the buffer and, therefore, indicate that a frequency response would have to have been calculated using, e.g., a DFT, at some prior time.

$$X_R = X_R \cos\theta - X_I \sin\theta \qquad \text{Equation 5}$$

$$X_I = X_I \cos\theta X_R \sin\theta \qquad \text{Equation 6}$$

As a new sample is added, the oldest sample is dropped from the buffer 504. To remove the spectral effects of the previous sample that was removed from the buffer 504, a subtractor 507 uses a twiddle factor provided by a twiddle factor calculator/storage 508 to adjust the spectral characteristics table. For example, if the twiddle factor is cos θ+j sin θ where $$\theta = \frac{2\pi k_m}{N_m},$$

this twiddle factor may be used to account for the spectral effects of shifting the oldest sample from the buffer. If the real and imaginary components of the buffer are represented as shown in Equations 5 and 6 below, the effect of removing the oldest sample from the buffer is shown in Equations 7 and 8, below.

$$X_R = X_R - A_0 \cos\theta \qquad \text{Equation 7}$$

$$X_I = X_I - A_0 \sin\theta \qquad \text{Equation 8}$$

In particular, Equation 7 removes the real component of the oldest sample from the frequency response of the buffer (i.e., the spectral characteristics table) by subtracting the cosine of the amplitude ($A_0$) of the sample. Equation 8 removes the imaginary component of the oldest sample from the frequency response of the buffer (i.e., the spectral characteristics table) by subtracting the sine of the amplitude ($A_0$) of the oldest sample.

As explained above, the audio may be encoded using any designated combination or combinations of audio block size(s) and frequency index (indices). Thus, as explained above because the value of θ depends both on audio block size and frequency index, the twiddle factor calculator/storage 508 may calculate numerous θ values or cosine and sines of θ values, as shown in FIG. 6. In particular, as shown in FIG. 6, for each possible block size and frequency index combination used by the encoder, a cosine and sine value of θ is calculated. This prevents repeated calculations of the cosine and sine θ values, which depend on block size and frequency index. Storing the cosine and sine θ values allows simple multiplication of the oldest sample magnitude by the stored cosine and sine θ values to facilitate rapid calculation of the results of Equations 7 and 8. Additionally, although not shown in FIG. 6, the twiddle factor calculator/storage 508 may store the various 0 values, which would require additional operations to calculate sine and cosine values thereof.

Having removed the effects of the oldest sample to be removed from the buffer through the use of the subtractor 507, the spectral effects of the newest sample to be added to the buffer need to be added by an adder 510 to the results provided by the subtractor 507. That is the spectral characteristics table needs to be updated to reflect the addition of the newest sample. As shown in Equations 9 and 10, the effects of the new sample are determined by calculating the magnitude of the new sample and multiplying the magnitude of the new sample by a cosine or sine of a second twiddle factor that is provided by a second twiddle factor calculator/storage 512.

$$X_R = X_R + A_x \cos \varphi \qquad \text{Equation 9}$$

$$X_I = X_I + A_x \sin \varphi \qquad \text{Equation 10}$$

Wherein, the twiddle factor φ is $$\frac{2\pi k_m p}{N_m} \text{ and } p = N_m - (M \bmod N_m).$$

This twiddle factor is calculated from the implied sample position of the last sample in an array of blocks of size $N_m$. In the foregoing, the variable p is used to compensate between the buffer size M (e.g., 18,432) and the size of block size to be used to determine spectral components ($N_m$).

As shown above, the value of variable φ depends both on block size and frequency index. Because the decoder 116 needs to determine if information is encoded in a received signal at any of various frequency locations dictated by the block size and frequency index, the twiddle factor calculator/storage 512 may include a table such as the table of FIG. 7 in which cosine and sine values of φ are predetermined for the possible block size and frequency index combinations. In this manner, the magnitude of the new sample may be multiplied by the sine and cosine values of φ, thereby saving the computational overhead of the cosine and sine operations. Additionally or alternatively, the table of FIG. 7 may include only the various φ values, thereby only requiring sine and cosine operations, as well as multiplication by the amplitude of the new sample.

An alternate representation of the mathematics underlying Equations 5-10 is provided below in conjunction with Equations 11-18. Equation 11 shows a standard representation of a DFT, wherein $x_n$ are the time-domain real-valued samples, N is the DFT size, $Y_{k,N}(t)$ is a complex-valued Fourier coefficient calculated at time t from N previous samples $\{x_n\}$, and k is the frequency (bin) index.

$$Y_{k,N}(t) = \sum_{n=0}^{N-1} x_n e^{-2\pi j \frac{k}{N} n} \qquad \text{Equation 11}$$

A slight modification to Equation 11, allows the upper index of the samples in the summation to be represented by the variable M, as shown in Equation 12. Essentially, Equation 12 decouples the resolution of the DFT from the number of samples (N).

$$Y_{k,N}(t) = \sum_{n=0}^{M-1} x_n e^{-2\pi j \frac{k}{N} n} \qquad \text{Equation 12}$$

Equation 12 represents that in the summation the signal ($x_0$, $x_1$, . . . , $x_{M-1}$) is projected onto a basis vector $$\left(e^{-2\pi j \frac{k}{N} 0}, e^{-2\pi j \frac{k}{N} 1}, \ldots, e^{-2\pi j \frac{k}{N}(M-1)}\right).$$

This new set of basis vectors with k=0, 1, . . . , N frequency indices is no longer orthogonal. Practically, even if the input samples represent a sine wave corresponding to one of the basis frequencies k=0, 1, . . . , N the modified transform will produce more than one non-zero Fourier coefficient, in contrast to standard DFT.

To obtain a recursive expression for computing the value $Y_{k,N}(t)$ given in Equation 12, assuming that $x_0$ is the oldest sample and $x_M$ is the newest incoming sample we find the result as shown in Equation 13 for the next discrete time instant t+1.

$$Y_{k,N}(t+1) = \sum_{n=0}^{M-1} x_{n+1} e^{-2\pi j \frac{k}{N} n} = \sum_{m=1}^{M} x_m e^{-2\pi j \frac{k}{N} m} e^{-2\pi j \frac{k}{N}} \qquad \text{Equation 13}$$

In Equation 13, the summation index n is replaced with m=n+1. Equation 13 can be rewritten in three equivalent ways, as shown in Equations 14-16, below.

$$Y_{k,N}(t+1) = e^{-2\pi j \frac{k}{N}} \left[\sum_{m=1}^{M} x_m e^{-2\pi j \frac{k}{N} m} + x_0 - x_0\right] = \qquad \text{Equation 14}$$

$$= e^{2\pi j \frac{k}{N}} \left[\sum_{m=0}^{M-1} x_m e^{-2\pi j \frac{k}{N} m} - x_0 + e^{-2\pi j \frac{k}{N} M} x_M\right] = \qquad \text{Equation 15}$$

$$= e^{2\pi j \frac{k}{N}} \left[Y_{k,N}(t) - x_0 + e^{-2\pi j \frac{k}{N} M} x_M\right] \qquad \text{Equation 16}$$

The Equation 16 shows how to compute $Y_{k,N}$ (t+1) if the value of $Y_{k,N}(t)$ is already known, without explicit summation based on definition in Equation 12. The recursion can be expressed in terms of real and imaginary parts of the complex valued Fourier coefficients, as shown in Equations 17 and 18.

$$\begin{aligned} \mathrm{Re}Y_{k,N}(t+1) = {} & \cos\left(2\pi \frac{k}{N}\right) \mathrm{Re}Y_{k,N}(t+1) - \sin\left(2\pi \frac{k}{N}\right) \mathrm{Im}Y_{k,N}(t+1) - \\ & \cos\left(2\pi \frac{k}{N}\right) x_0 + \cos\left(2\pi \frac{k}{N}(M - 1 \bmod N)\right) x_M \end{aligned} \qquad \text{Equation 17}$$

$$\begin{aligned} \mathrm{Im}Y_{k,N}(t+1) = {} & \sin\left(2\pi \frac{k}{N}\right) \mathrm{Re}Y_{k,N}(t+1) + \cos\left(2\pi \frac{k}{N}\right) \mathrm{Im}Y_{k,N}(t+1) - \\ & \sin\left(2\pi \frac{k}{N}\right) x_0 + \sin\left(2\pi \frac{k}{N}(M - 1 \bmod N)\right) x_M \end{aligned} \qquad \text{Equation 18}$$

Equation 17 corresponds to the operations described above in conjunction with Equations 5, 7, and 9. Equation 18 corresponds to the operations described above in conjunction with Equations 6, 8, and 10. The forgoing mathematical example presumes that samples are shifted into the buffer 504 one sample at a time and that the spectrum of the buffer is updated after each sample is added. However, in other examples, four, sixteen, or any other suitable number of samples may be shifted into the buffer 504 at any time. After the samples are shifted in, the total effect of the samples is evaluated. For example, if four new samples are shifted into the buffer 504, and four old samples are shifted out of the buffer, the spectral characteristics of the buffer are evaluated after the four shifts. By updating the spectral characteristics after multiple shifts, the calculation associated with updating the spectral characteristics of the buffer 504 is reduced. Additionally, while the foregoing example mathematical developments are derived from attributes of a DFT, other derivations are possible. Accordingly, other transforms such as Walsh transforms, Haar transforms, wavelet transforms, and the like may be used.

The results of the subtraction and the addition to the information in the buffer is stored, for example, in a spectral characteristics table, such as the table shown in FIG. 8, which may be stored in a buffer, or any other form of memory. As shown in FIG. 8, the complex version of the variable X (or the separate constituent real and imaginary components thereof) are shown in table cells relating to block size and frequency index combinations. As will be readily appreciated, the table of FIG. 8 may be used to maintain the values of the real and imaginary components of the frequencies corresponding to combinations of block sizes and frequency indices. Thus, the values in the table of FIG. 8 may be subtracted from using the subtractor 507 or added to using the adder 510 to maintain the spectral characteristics table in consistency with the spectral attributes of the audio samples in the buffer.

An analyzer 514 looks for patterns in the energies of the table of FIG. 8 to determine if information has been transmitted. Additionally, the analyzer 514 may store one or more historic versions of the information in the table of FIG. 8. By storing multiple historic versions, the trends of various frequency components may be monitored over time because each historic version of the table of FIG. 8 represents what the energies of signals at particular block sizes and frequency indices were at previous times. Additionally, historic information regarding frequency components is useful for detecting synchronization symbols.

Consider for example the symbol S2 that may be encoded using any one of the tables 300, 330, or 360 of FIG. 3A, 3B, or 3C. If a symbol were encoded using the table 3A, the analyzer 514 would perceive a boost in the energy in the table of FIG. 8 in the cell corresponding to frequency index 40 and the symbol would be dictated by the block size having the maximum amplitude. Thus, the analyzer 514 would process the table of FIG. 8 to determine the maximum energy in the row corresponding to the frequency index 40. This may be carried out by normalizing the row in proportion to the maximum amplitude in the table row corresponding to frequency index 40. If, for example, the normalization reveals that the row entry corresponding to block size 336 (presuming the sampling rate at the decoder is 8 kHz, or one-sixth of the sampling frequency of the encoder) is the maximum, then the analyzer determines that the symbol S2 was encoded.

Alternatively, if the encoder used the table 330 of FIG. 3B, the analyzer 514 would process the table of FIG. 8 to look for emphasis that may be used in accordance with FIG. 3B. For example, the analyzer 514 normalizes each row corresponding to a frequency index to the maximum amplitude in that row and then sums the normalized values in each column to determine for which combination block sizes and frequency indices the sum is maximum. The maximum sum most likely corresponds to the information symbol that was sent. For example, if the symbol S2 were encoded using the table 330 of FIG. 3B, normalized column corresponding to block size 2016 would likely have the maximum sum. Of course, other techniques may be used to determine which received components are emphasized based on the encoding table used.

As a further alternative, if the symbol S2 were encoded using the table 360 of FIG. 3C, the analyzer 514 likely find that the table of FIG. 8 included emphasis in the cells corresponding to frequency indices 40 and 56 of block size 2016, frequency indices 88 and 104 corresponding to block size 2034, and frequency indices 120, 136 of block size 2004.

As will be readily appreciated, the decoder 116 may be aware of the lookup table that is selected to encode information into the audio signal by the encoder 102. Thus, the tables of FIGS. 6-8 may be reduced in their extent if, for example, certain block sizes or frequency indices will not be used to send information.

Figure 9:
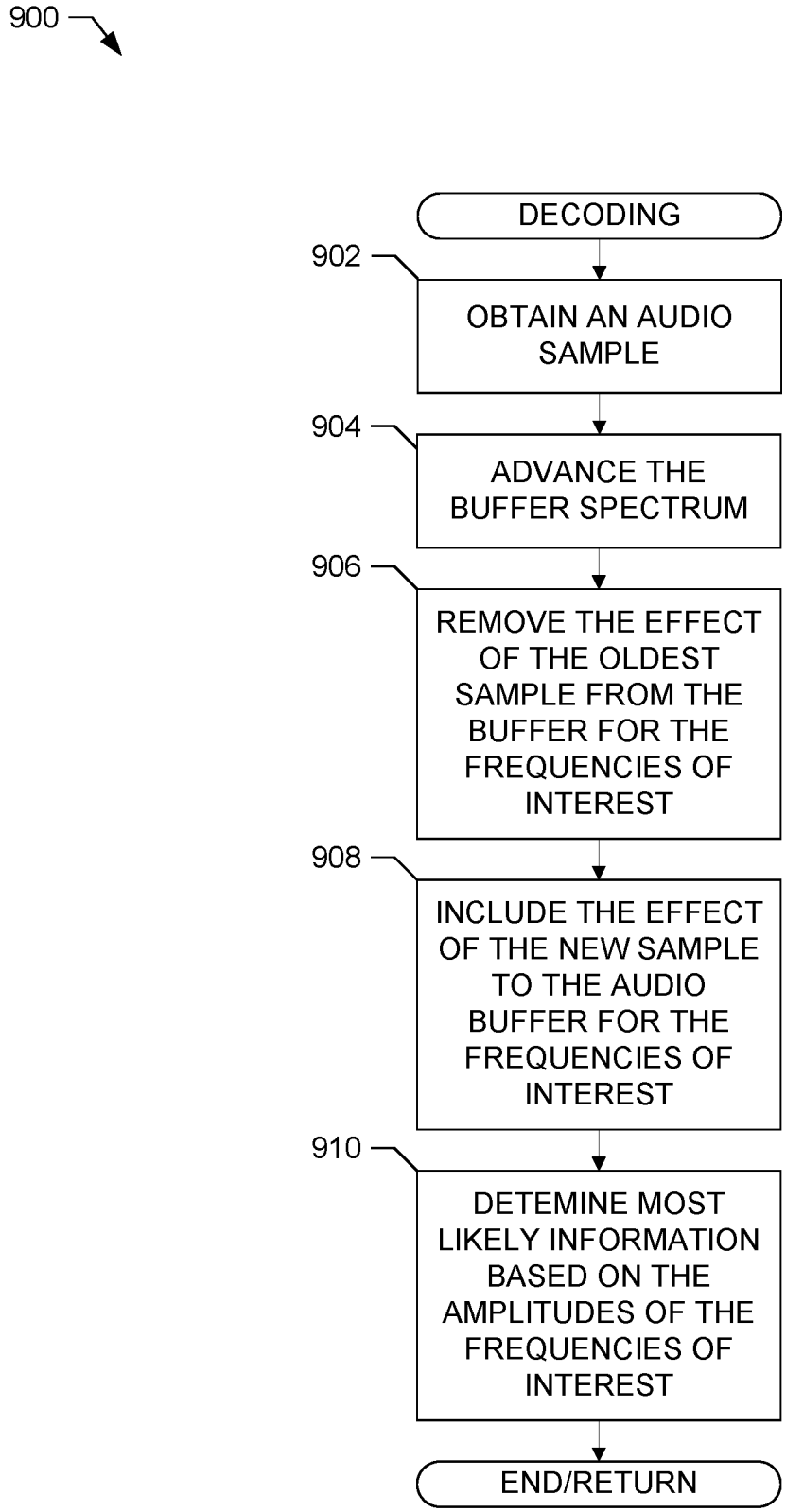
FIG. 9 is a flow diagram illustrating an example decoding process that may be carried out by the example decoder of FIG. 5.

As shown in FIG. 9, a decoding process 900 includes obtaining an audio sample (block 902), which may, for example, be carried out by the sampler 502 of the decoder 116 of FIG. 5. The process 900 then advances the spectrum of the buffer, which is stored in the table of FIG. 8, to account for time that has elapsed since the spectrum updated (block 904). This processing is described above in conjunction with Equations 5, 6, 17, and 18. Of course, more than one sample may be shifted into the buffer 504 at one time. Accordingly, the spectrum of the buffer may need to be advanced more than one sample time.

The process 900 then removes the effect of the oldest sample from a buffer of samples for the frequencies of interest (block 906). For example, as described above, the removal may be carried out by subtracting the effect of the oldest buffer sample from the frequencies corresponding to frequency indices and block sizes of interest (for example, the frequency indices and block sizes that may be used to carry additional information, as shown in the spectral characteristics table of FIG. 8).

The process 900 then includes the effects of the new audio sample added to the buffer (block 908). In one example, the inclusion may be the addition of the energy in the frequency components of interest provided by the new audio sample, as described above in conjunction with FIG. 5.

After the effects of the oldest sample have been removed (block 906) and the effects of the new sample have been included (block 908), the process 900 determines the most likely information in the audio signal based on the amplitudes or energies of the frequencies of interest (block 910). As noted above, the most likely information may be obtained by reviewing historic energies that are stored in one or more historic spectral characteristic tables, such as shown in FIG. 8. Using the historic spectral characteristic tables enables the decoder 116 and the decoding process 900 to determine the values of signals corresponding to block sizes and frequency indices that occurred in the past.

While example manners of implementing any or all of the example encoder 102 and the example decoder 116 have been illustrated and described above one or more of the data structures, elements, processes and/or devices illustrated in the drawings and described above may be combined, divided, re-arranged, omitted, eliminated and/or implemented in any other way. Further, the example encoder 102 and example decoder 116 may be implemented by hardware, software, firmware and/or any combination of hardware, software and/or firmware. Thus, for example, the example encoder 102 and the example decoder 116 could be implemented by one or more circuit(s), programmable processor(s), application specific integrated circuit(s) (ASIC(s)), programmable logic device(s) (PLD(s)) and/or field programmable logic device(s) (FPLD(s)), etc. For example, the decoder 116 may be implemented using software on a platform device, such as a mobile telephone. If any of the appended claims is read to cover a purely software implementation, at least one of the example sampler 202, the example masking evaluator 204, the example code frequency selector 206, the example synthesizer 208, and the example combiner 210 of the encoder 102 and/or one or more of the example sampler 502, the example buffer 504, the example compensator 506, the example subtractor 507, the example adder 510, the example twiddle factor tables 508, 512, and the example analyzer 514 of the example decoder 116 are hereby expressly defined to include a tangible medium such as a memory, DVD, CD, etc. Further still, the example encoder 102 and the example decoder 116 may include data structures, elements, processes and/or devices instead of, or in addition to, those illustrated in the drawings and described above, and/or may include more than one of any or all of the illustrated data structures, elements, processes and/or devices.

Figure 10:
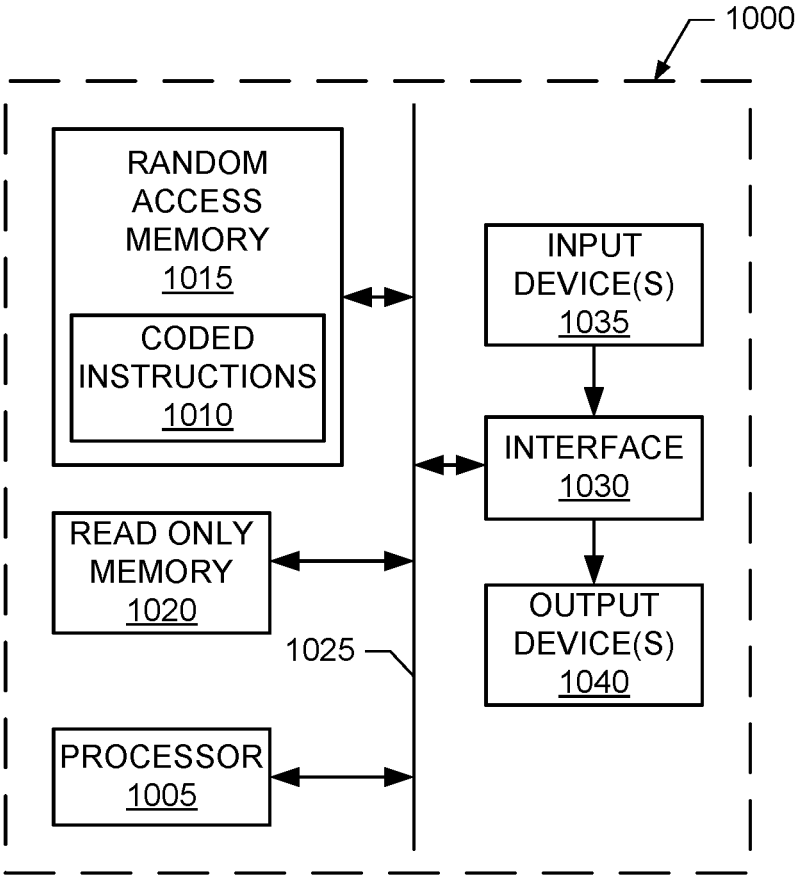
FIG. 10 is a schematic illustration of an example processor platform that may be used and/or programmed to perform any or all of the processes or implement any or all of the example systems, example apparatus and/or example methods described herein.

FIG. 10 is a schematic diagram of an example processor platform 1000 that may be used and/or programmed to implement any or all of the example encoder 102 and the decoder 116, and/or any other component described herein. For example, the processor platform 1000 can be implemented by one or more general purpose processors, processor cores, microcontrollers, etc. Additionally, the processor platform 1000 be implemented as a part of a device having other functionality. For example, the processor platform 1000 may be implemented using processing power provided in a mobile telephone, or any other handheld device.

The processor platform 1000 of the example of FIG. 10 includes at least one general purpose programmable processor 1005. The processor 1005 executes coded instructions 1010 and/or 1012 present in main memory of the processor 1005 (e.g., within a RAM 1015 and/or a ROM 1020). The processor 1005 may be any type of processing unit, such as a processor core, a processor and/or a microcontroller. The processor 1005 may execute, among other things, example machine accessible instructions implementing the processes described herein. The processor 1005 is in communication with the main memory (including a ROM 1020 and/or the RAM 1015) via a bus 1025. The RAM 1015 may be implemented by DRAM, SDRAM, and/or any other type of RAM device, and ROM may be implemented by flash memory and/or any other desired type of memory device. Access to the memory 1015 and 1020 may be controlled by a memory controller (not shown).

The processor platform 1000 also includes an interface circuit 1030. The interface circuit 1030 may be implemented by any type of interface standard, such as a USB interface, a Bluetooth interface, an external memory interface, serial port, general purpose input/output, etc. One or more input devices 1035 and one or more output devices 1040 are connected to the interface circuit 1030.

Although certain example apparatus, methods, and articles of manufacture are described herein, other implementations are possible. The scope of coverage of this patent is not limited to the specific examples described herein. On the contrary, this patent covers all apparatus, methods, and articles of manufacture falling within the scope of the invention.

What is claimed is:

1. An apparatus to encode auxiliary data in audio, the apparatus comprising:

means for selecting a first frequency from a set of frequencies based on a first symbol in a code, and for selecting a first block size based on the first symbol and the code, a combination of the first block size and the first frequency to represent the first symbol;

means for synthesizing a code frequency according to the first block size and the first frequency; and means for embedding the first symbol in a first block of input audio samples of the audio having the first block size, the means for embedding to embed the code frequency a in the first block of input audio samples to form a block of encoded audio samples encoded with the first symbol, the code frequency and the first block of input audio samples to overlap in time.

2. The apparatus of claim 1, wherein the block of encoded audio samples is padded with a number of unmodified samples corresponding to a difference between the first block size and a predetermined block size.

3. The apparatus of claim 1, wherein the first block size includes a number of samples of the audio.

4. The apparatus of claim 1, wherein the first symbol encoded in the block of encoded audio samples is detectable at the first frequency when the block of encoded audio samples is decoded using the first block size and the first symbol is not detectable at the first frequency when the block of encoded audio samples is decoded using a second block size different than the first block size.

5. The apparatus of claim 1, wherein the means for selecting the first frequency is to access a lookup table based on the first symbol to select the first frequency and the first block size.

6. An article of manufacture comprising instructions which, when executed, cause a machine to at least:

sample an audio signal to create an audio block in a buffer having a buffer size;

store one or more components of a frequency domain representation of the audio block in a spectral characteristics table;

obtain a subsequent sample of the audio signal;

adjust the stored components in the spectral characteristics table in accordance with elapsed time since generating the frequency domain representation to form a modified frequency domain representation;

remove a spectral effect of an oldest sample in the audio block from the modified frequency domain representation stored in the spectral characteristics table;

add a spectral effect of the subsequent sample of the audio signal to the modified frequency domain representation stored in the spectral characteristics table to form an updated frequency domain spectrum in the spectral characteristics table;

analyze the updated frequency domain spectrum to determine emphasis of one or more frequency components; and determine auxiliary information corresponding to the emphasis of one or more frequency components.

7. The article of manufacture of claim 6, wherein the instructions cause the machine to store the one or more components of the frequency domain representation of the audio block in the spectral characteristics table by storing only those frequency components that may be used by an encoder to include the auxiliary information in the audio signal.

8. The article of manufacture of claim 6, wherein the instructions cause the machine to adjust the stored components in the spectral characteristics table by multiplying a real component of the frequency domain representation with a cosine function of a first phase angle.

9. The article of manufacture of claim 8, wherein the instructions cause the machine to adjust the stored components in the spectral characteristics table by multiplying an imaginary component of the frequency domain representation by a sine function of the first phase angle.

10. The article of manufacture of claim 9, wherein the phase angle is a function of a block size and a frequency index.

11. The article of manufacture of claim 10, wherein the instructions cause the machine to remove the spectral effect of the oldest sample in the audio block from the modified frequency domain representation stored in the spectral characteristics table by multiplying an amplitude of the oldest sample with a cosine of the first phase angle.

12. The article of manufacture of claim 11, wherein the instructions cause the machine to add the spectral effect of the subsequent sample of the audio signal to the modified frequency domain representation stored in the spectral characteristics table by multiplying an amplitude of the subsequent sample with a cosine of a second phase angle, the second phase angle being a function of the block size, the frequency index, and a compensation factor.

13. The article of manufacture of claim 12, wherein the compensation factor compensates between the buffer size and the block size.

14. The article of manufacture of claim 13, wherein the instructions cause the machine to determine the spectral effect of the subsequent sample in conjunction with determining the spectral effect of several samples of the audio signal.

15. An apparatus for detecting the presence of auxiliary information in an audio signal, wherein the auxiliary information is imparted onto the audio signal by emphasizing one or more frequency components of the audio signal, the apparatus comprising:

means for sampling the audio signal to create an audio block in a buffer having a buffer size;

means for storing one or more components of a frequency domain representation of the audio block in a spectral characteristics table;

means for adjusting the stored components in the spectral characteristics table in accordance with elapsed time since generating the frequency domain representation to form a modified frequency domain representation;

means for removing a spectral effect of an oldest sample in the audio block from the modified frequency domain representation stored in the spectral characteristics table;

means for adding a spectral effect of a subsequent sample of the audio signal to the modified frequency domain representation stored in the spectral characteristics table to form an updated frequency domain spectrum in the spectral characteristics table; and means for analyzing the updated frequency domain spectrum to determine emphasis of one or more frequency components, and for determining auxiliary information corresponding to the emphasis of one or more frequency components.

16. The apparatus of claim 15, wherein the one or more components only correspond to those frequency components that may be used to include the auxiliary information in the audio signal.

17. The apparatus of claim 15, wherein the means for adjusting the stored components in the spectral characteristics table is to multiply a real component of the frequency domain representation with a cosine function of a first phase angle.

18. The apparatus of claim 17, wherein the means for adjusting the stored components in the spectral characteristics table is to multiply an imaginary component of the frequency domain representation by a sine function of the first phase angle.

19. The apparatus of claim 18, wherein the phase angle is a function of a block size and a frequency index.

* * * * *